US012298026B1

(12) United States Patent
Jones et al.

(10) Patent No.: US 12,298,026 B1
(45) Date of Patent: May 13, 2025

(54) LATENT ENERGY TRANSFER LAMINATE FOR PLATE PACK CORE

(71) Applicant: W. L. Gore & Associates, Inc., Newark, DE (US)

(72) Inventors: Carl H. Jones, Arlington, VA (US); John E. Trouba, Avondale, PA (US)

(73) Assignee: W. L. Gore & Associates, Inc., Newark, DE (US)

( * ) Notice: Subject to any disclaimer, the term of this patent is extended or adjusted under 35 U.S.C. 154(b) by 507 days.

(21) Appl. No.: 17/717,323

(22) Filed: Apr. 11, 2022

Related U.S. Application Data

(60) Provisional application No. 63/173,901, filed on Apr. 12, 2021.

(51) Int. Cl.

| | |
|---|---|
| ***F28D 21/00*** | (2006.01) |
| ***F24F 12/00*** | (2006.01) |
| ***F28D 9/00*** | (2006.01) |
| ***F28F 13/02*** | (2006.01) |

(52) U.S. Cl.
CPC ..... *F24F 12/006* (2013.01); *F28D 9/0025* (2013.01); *F28D 21/0015* (2013.01); *F28F 13/02* (2013.01)

(58) Field of Classification Search
CPC .... F28D 21/0015; F28D 9/0025; F28F 13/02; F24F 12/006
See application file for complete search history.

(56) References Cited

U.S. PATENT DOCUMENTS

| | | | | |
|---|---|---|---|---|
| 5,718,848 | A * | 2/1998 | James | F28D 5/02 261/153 |
| 9,234,665 | B2 | 1/2016 | Erb et al. | |
| 10,302,317 | B2 | 5/2019 | Erb et al. | |
| 2006/0090650 | A1 * | 5/2006 | Yamakawa | F28D 21/0015 96/11 |
| 2008/0085437 | A1 | 4/2008 | Dean et al. | |
| 2010/0313757 | A1 | 12/2010 | Crabtree et al. | |

(Continued)

FOREIGN PATENT DOCUMENTS

| | | | | |
|---|---|---|---|---|
| CN | 1328564 C | * | 7/2007 | F24F 3/147 |
| EP | 0661502 A2 | | 7/1995 | |

(Continued)

OTHER PUBLICATIONS

Al-Wakad et al., "Enhancing the performance of energy recovery ventilators," Energy Conversion and Management, vol. 171, Sep. 1, 2018, pp. 196-210.

(Continued)

*Primary Examiner* — Devon Russell

(57) ABSTRACT

Various aspects of the present disclosure are directed toward apparatuses, systems and methods that include an airflow conditioning device. The airflow conditioning device includes a channels defining airflow pathways through the airflow conditioning device. A heat and moisture exchanger is disposed in the airflow conditioning device with a plurality of air-permeable barriers separating the airflow pathways. The airflow conditioning device includes air-permeable barriers with a layer of a microporous film and a water vapor permeable resin layer adjoined to one or both of the surfaces of the microporous film as either a continuous microporous coating or a discontinuous coating.

18 Claims, 21 Drawing Sheets

(56) References Cited

U.S. PATENT DOCUMENTS

| | | | |
|---|---|---|---|
| 2012/0205081 | A1 | 8/2012 | Terai et al. |
| 2016/0194832 | A1 | 7/2016 | Ono et al. |
| 2017/0370609 | A1 | 12/2017 | Chlup et al. |
| 2019/0162429 | A1 | 5/2019 | Armatis et al. |
| 2019/0186846 | A1 | 6/2019 | Hirsch et al. |
| 2020/0033076 | A1 | 1/2020 | Riendeau |

FOREIGN PATENT DOCUMENTS

| | | | | |
|---|---|---|---|---|
| EP | 1652663 | A3 | | 7/2007 |
| JP | 58-178188 | A | | 10/1983 |
| JP | 2006097958 | A | * | 4/2006 |
| JP | 2008-089199 | A | | 4/2008 |
| JP | 2013-194934 | A | | 9/2013 |
| WO | 2014/138859 | A1 | | 9/2014 |
| WO | 2016/074077 | A1 | | 5/2016 |

OTHER PUBLICATIONS

Albdoor et al., "Experimental investigation and performance evaluation of a mixed-flow air to air membrane enthalpy exchanger with different configurations," Applied Thermal Engineering, vol. 166, Feb. 5, 2020, 114682.

Alexiadis et al., "Laminar Flow Transitions in a 2D Channel with Circular Spacers," Industrial & Engineering Chemistry Research, vol. 46, No. 16, Jul. 10, 2007, pp. 5387-5396.

Baldinelli et al., "Experimental analysis of an innovative organic membrane for air to air enthalpy exchangers," International Communications in Heat and Mass Transfer, vol. 108, Sep. 13, 2019, 7 pages.

Egarnevis et al., "Heat and mass transfer modeling in enthalpy exchangers using asymmetric composite membranes," Journal of Membrane Science, vol. 556, Mar. 10, 2018, pp. 248-262.

Ghaedamini et al., "Experimental parametric study on performance of a membrane heat and moisture exchanger with partially blocked channels at isothermal condition," Applied Thermal Engineering, vol. 175, Jul. 5, 2020, 115400.

Lim et al., "A CFD study on the effect of membrane permeance on permeate flux enhancement generated by unsteady slip velocity," Journal of Membrane Science, vol. 556, Mar. 28, 2018, pp. 138-145.

Van et al., "Measurement of Moisture Transport in the Membrane-Based Enthalpy Exchanger," The European Physical Journal Conferences, vol. 45, Apr. 2013, 5 pages.

* cited by examiner

Latent efficiency (moisture transport across barrier) improvement over prior art product across a range of Reynolds Numbers (Re)

1000

1106

1104

1006

LATENT ENERGY TRANSFER LAMINATE FOR PLATE PACK CORE

CROSS-REFERENCE TO RELATED APPLICATION

This application claims the benefit of Provisional Application No. 63/173,901, filed Apr. 12, 2021, which is incorporated herein by reference in its entirety for all purposes.

FIELD

The present disclosure relates generally to apparatuses, systems, and methods for airflow conditioning devices. More specifically, the disclosure relates to apparatuses, systems, and methods that include microporous barriers for latent and/or sensible energy transfer in airflow conditioning devices.

BACKGROUND

Energy exchange assemblies are used to transfer energy, such as sensible and/or latent energy, inclusively between fluid streams. Air-to-air energy recovery cores may be used in heating, ventilation, and air conditioning (HVAC) applications to transfer heat (sensible energy) and moisture (latent energy) inclusively between two airstreams.

Various prior assemblies used to transfer energy (e.g., as part of an Air-to-air Energy Recovery Ventilator or Dedicated Outdoor Air Supply) have done so on either a non-porous barrier or a porous film for latent energy transfer. However, using non-porous barriers results in a low efficiency of latent energy transfer, and using porous films results in a high air permeability through the structures.

SUMMARY

According to one example ("Example 1"), an airflow conditioning device is disclosed such that the device includes: a first channel defining a first airflow pathway through the airflow conditioning device and a second channel defining a second airflow pathway through the airflow conditioning device; and a heat and moisture exchanger disposed in the airflow conditioning device. The first and second channels each passes through the heat and moisture exchanger. The heat and moisture exchanger includes a plurality of air-permeable barriers separating the first airflow pathway from the second airflow pathway. At least one of the plurality of air-permeable barriers includes: a layer of a microporous film having a first surface and a second surface opposite of the first surface, and a water vapor permeable resin layer adjoined to the first surface, the second surface, or both the first and second surfaces of the microporous film as either a continuous microporous coating or a discontinuous coating.

According to another example ("Example 2") further to Example 1, the discontinuous coating is a discontinuous microporous coating.

According to another example ("Example 3") further to Example 1, the discontinuous coating is a discontinuous nonporous coating.

According to another example ("Example 4") further to Example 1, the microporous film includes expanded polytetrafluoroethylene (ePTFE), expanded Polyethylene (ePE), or a combination thereof.

According to another example ("Example 5") further to Example 1, the water vapor permeable resin layer includes polyurethane.

According to another example ("Example 6") further to Example 1, the microporous film is adjoined to a mesh.

According to another example ("Example 7") further to Example 1, the microporous film is heat laminated to an extruded mesh component.

According to another example ("Example 8") further to Example 1, the microporous film is a component of a nonwoven fabric.

According to another example ("Example 9") further to Example 1, the microporous film is dot laminated to a nonwoven fabric.

According to another example ("Example 10") further to Example 1, the device further includes a boundary layer defined by a surface of the at least one of the plurality of air-permeable barriers, and at least one spacer arranged at or adjacent to the surface of the at least one of the plurality of air-permeable barriers to disrupt a portion of the boundary layer.

According to another example ("Example 11") further to Example 10, the disrupted portion of the boundary layer includes a reduced-thickness region of the boundary layer in which heat or water vapor transfer through the at least one of the air-permeable barriers is enhanced with respect to an undisrupted portion of the boundary layer.

According to another example ("Example 12") further to Example 1, the layer of microporous film includes a porosity of no greater than 90%.

According to another example ("Example 13") further to Example 1, the at least one of the plurality of air-permeable barriers includes a latent efficiency of at least 70% at a Re value of inclusively between 50 and 85.

According to another example ("Example 14") further to Example 1, the at least one of the plurality of barriers has an air permeability of inclusively between 300 and 5000 Gurley seconds.

According to another example ("Example 15") further to Example 1, the discontinuous coating is applied in a substantially uniform distribution on the first surface, the second surface, or both the first and second surfaces.

According to another example ("Example 16") further to Example 15, the discontinuous coating is applied in a pattern on the first surface, the second surface, or both the first and second surfaces.

According to one example ("Example 17"), a method of conditioning an airflow passing through an airflow conditioning device is disclosed such that the method includes: directing a first airflow through a first airflow pathway through the airflow conditioning device and directing a second airflow through a second airflow pathway through the airflow conditioning device; directing both the first and second airflows through a heat and moisture exchanger disposed within the airflow conditioning device, the heat and moisture exchanger having a plurality of air-permeable barriers separating the first airflow from the second airflow; and conditioning the second airflow by transferring thermal energy and humidity from the first airflow to the second airflow through at least one of the plurality of air-permeable barriers. The at least one of the plurality of air-permeable barriers includes a layer of a microporous film and a water vapor permeable resin layer adjoined to a first surface of the microporous film, a second surface of the microporous film opposite from the first surface, or both the first and second surfaces of the microporous film as either a continuous microporous coating or a discontinuous coating.

According to another example ("Example 18") further to Example 17, the layer of microporous film includes expanded polytetrafluoroethylene (ePTFE), expanded polyethylene (ePE), or a combination thereof.

According to one example ("Example 19"), a system is disclosed, including a first channel defining a first airflow pathway through the airflow conditioning device and a second channel defining a second airflow pathway through the airflow conditioning device; and a heat and moisture exchanger disposed within the airflow conditioning device. The heat and moisture exchanger includes a plurality of air-permeable barriers separating the first airflow pathway from the second airflow pathway. At least one of the plurality of air-permeable barriers includes a layer of a microporous film having a first surface and a second surface opposite of the first surface, and a water vapor permeable resin layer adjoined to the first surface, the second surface, or both the first and second surfaces of the microporous film as either a continuous microporous coating or a discontinuous coating.

According to another example ("Example 20") further to Example 19, the layer of microporous film includes expanded polytetrafluoroethylene (ePTFE), expanded polyethylene (ePE), or a combination thereof.

The foregoing Examples are just that, and should not be read to limit or otherwise narrow the scope of any of the inventive concepts otherwise provided by the instant disclosure. While multiple examples are disclosed, still other embodiments will become apparent to those skilled in the art from the following detailed description, which shows and describes illustrative examples. Accordingly, the drawings and detailed description are to be regarded as illustrative in nature rather than restrictive in nature.

BRIEF DESCRIPTION OF THE DRAWINGS

The accompanying drawings are included to provide a further understanding of the disclosure and are incorporated in and constitute a part of this specification, illustrate embodiments, and together with the description serve to explain the principles of the disclosure.

DETAILED DESCRIPTION

Definitions and Terminology

Figure 1:
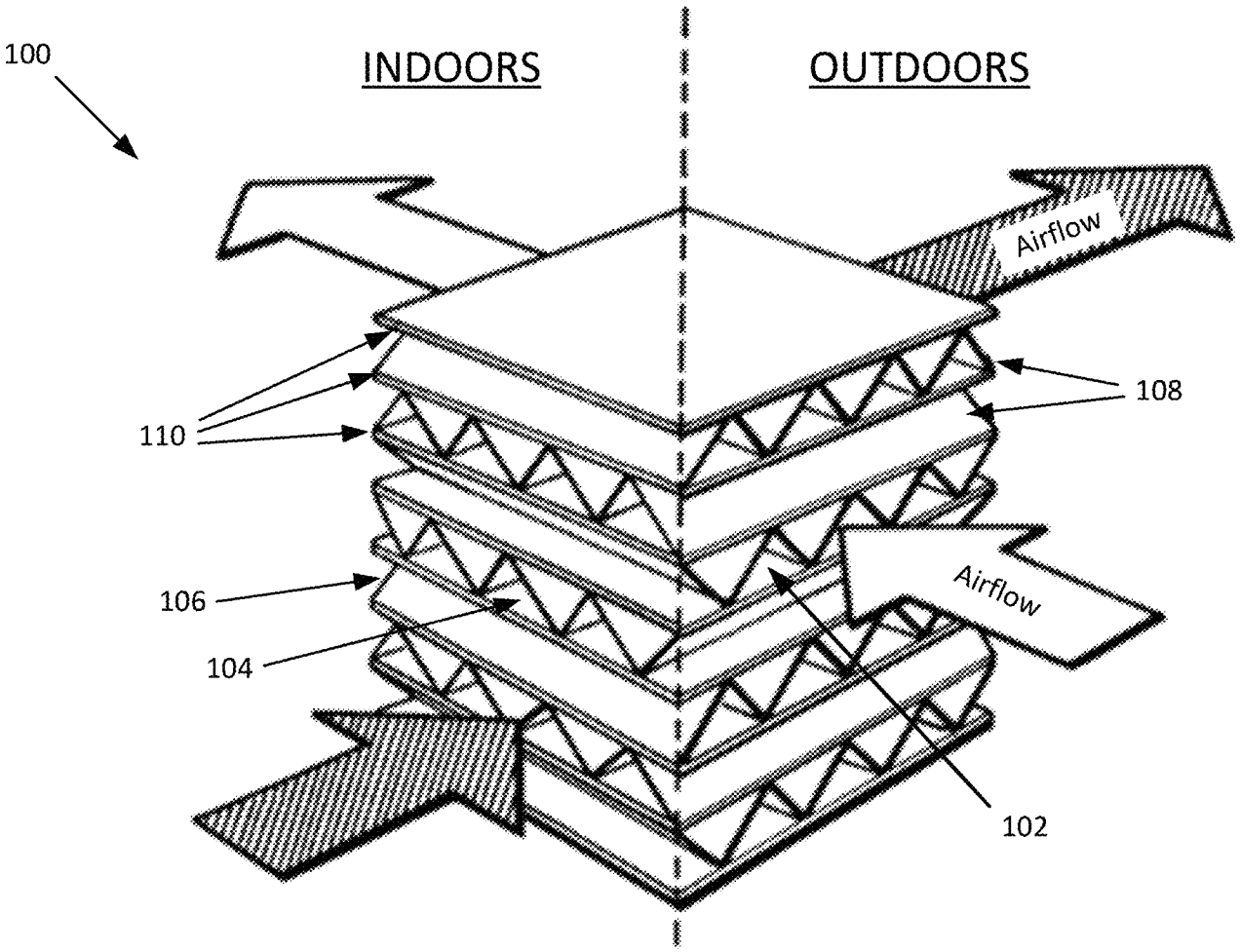
FIG. 1 is an example airflow conditioning device, in accordance with an embodiment disclosed herein.

This disclosure is not meant to be read in a restrictive manner. For example, the terminology used in the application should be read broadly in the context of the meaning those in the field would attribute such terminology.

With respect to terminology of inexactitude, the terms "about" and "approximately" may be used, interchangeably, to refer to a measurement that includes the stated measurement and that also includes any measurements that are reasonably close to the stated measurement. Measurements that are reasonably close to the stated measurement deviate from the stated measurement by a reasonably small amount as understood and readily ascertained by individuals having ordinary skill in the relevant arts. Such deviations may be attributable to measurement error, differences in measurement and/or manufacturing equipment calibration, human error in reading and/or setting measurements, minor adjustments made to optimize performance and/or structural parameters in view of differences in measurements associated with other components, particular implementation scenarios, imprecise adjustment and/or manipulation of objects by a person or machine, and/or the like, for example. In the event it is determined that individuals having ordinary skill in the relevant arts would not readily ascertain values for such reasonably small differences, the terms "about" and "approximately" can be understood to mean plus or minus 10% of the stated value.

Whenever terms such as "about" and "approximately" are used in association with numeric values, the exact values are also meant to be explicitly disclosed. For example, if the description below indicates a range of "from about X to about Y," also specifically disclosed is "from X to Y," and so forth. In other words, the description is meant to describe and disclose to the reader not only the possibility of some exactitude, but also the option to utilize those exact recited values in each instance.

DESCRIPTION OF VARIOUS EMBODIMENTS

Persons skilled in the art will readily appreciate that various aspects of the present disclosure can be realized by any number of methods and apparatuses configured to perform the intended functions. It should also be noted that the accompanying drawing figures referred to herein are not necessarily drawn to scale, but may be exaggerated to illustrate various aspects of the present disclosure, and in that regard, the drawing figures should not be construed as limiting.

Various aspects of the present disclosure are directed toward airflow conditioning devices such as an Air-to-air Energy Recovery Ventilator or Dedicated Outdoor Air Supply. The airflow conditioning devices, as discussed in further detail below, may reduce capital cost, energy consumption, and/or $CO_2$ emissions by balancing sensible and latent energy inclusively between a fresh supply air and exhaust air. In certain instances, the airflow conditioning devices may lower energy consumption and load of an HVAC system. The airflow conditioning devices may include a laminate for the plate pack core of an ERV to help recover energy (sensible and latent) by utilizing a highly efficient ERV thereby lowering peak energy load and consumption while maintaining high Indoor Air Quality (IAQ).

FIG. 1 is an airflow conditioning device 100, in accordance with an embodiment disclosed herein. The airflow conditioning device 100 may be a part of an Air-to-Air Energy Recovery Ventilator or Dedicated Outdoor Air Supply in certain instances. The airflow conditioning device 100 may be arranged inclusively between at least a first channel 102 defining a first airflow pathway through the airflow conditioning device 100 and a second channel 104 defining a second airflow pathway through the airflow conditioning device 100. In certain instances, the first channel 102 may be configured to direct a first airflow and the second channel 104 configured to direct a second airflow through the airflow conditioning device 100. Although the channels 102 and 104 as shown as triangular in cross-sectional shape, any other suitable shapes such as a rectangular cross-section may be employed, as shown in FIG. 2B, for example.

In certain instances, the airflow conditioning device 100 may include a heat and moisture exchanger 106 disposed within the airflow conditioning device 100. The air flow channels 102, 104 may pass through the heat and moisture exchanger 106 with a controlled transfer of heat and moisture. In certain instances, the heat and moisture exchanger 106 includes a series of barriers 110 separating the first airflow from the second airflow. In addition and as described in further detail below, one or more of the series of barriers 110 may include a layer of a microporous film. The microporous film may include expanded polytetrafluoroethylene (ePTFE), expanded Polyethylene (ePE), or a combination thereof.

In certain instances, the microporous film barrier(s) 110 may be separated by spacers 108, which may be support elements for separating and defining the distance between adjacent barriers 110. The microporous film barrier(s) 110 may be configured to balance latent and sensible energy inclusively between the air flows (e.g., an exhaust air stream and incoming fresh air stream) for an HVAC system, thereby lowering the energy usage and peak load requirement. In certain instances, the microporous film barrier(s) 110 may be water vapor transport laminates enabling high efficiency latent and sensible energy balance (e.g., in plate pack ERV systems).

In certain instances, the channels 102, 104 passing through the air conditioning device 100 may be configured such that of the channels 102, 104 brings outside air in and the other of the channels 102, 104 may be exhaust or return air. The microporous film barrier(s) 110 may be configured to condition both heat and moisture inclusively between the air flowing in the channels 102, 104. Warm and/or moist air within may be exchanged past cool and/or dry air.

Figure 2A:
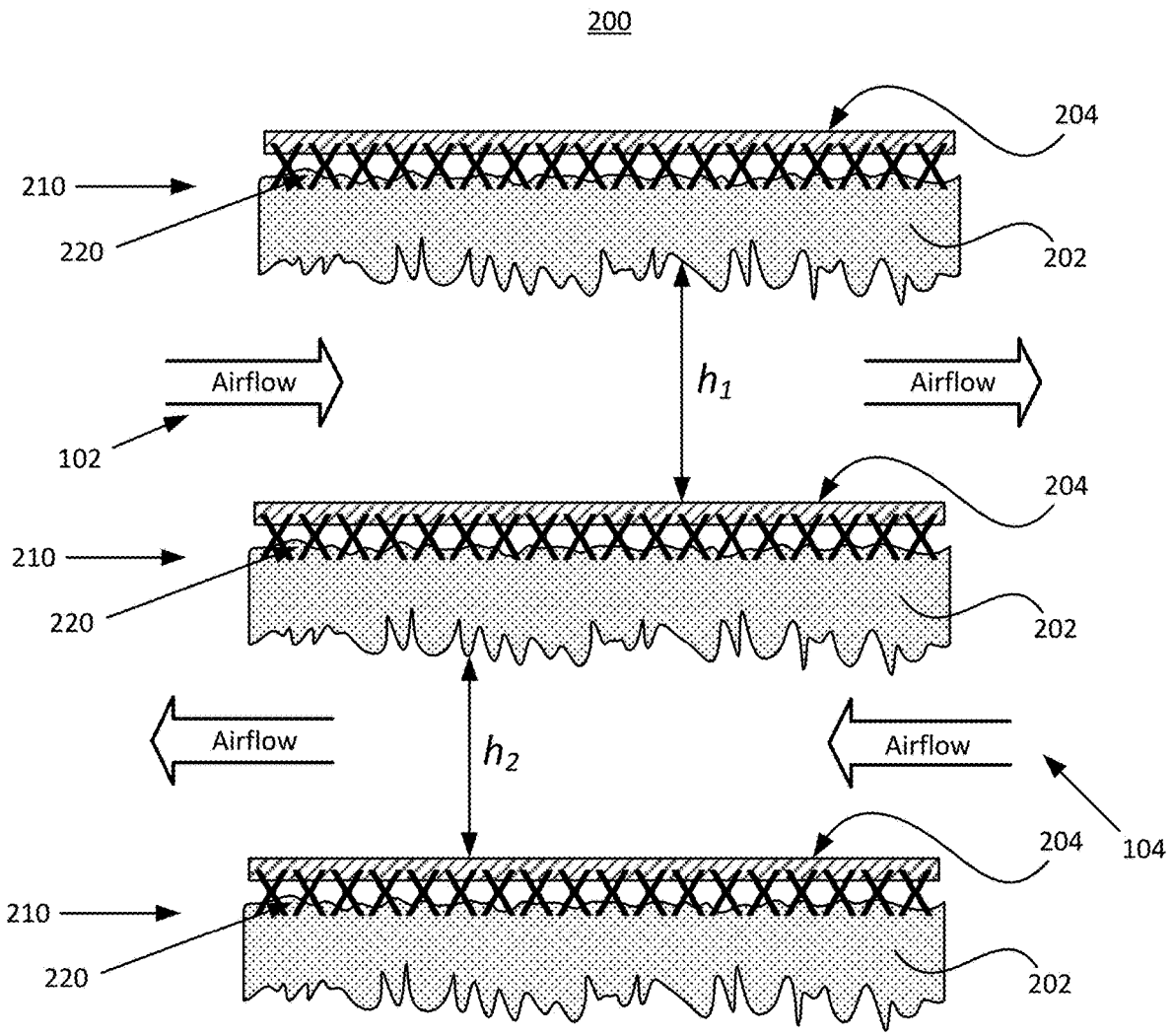
FIG. 2A is a cross-sectional illustration of an example airflow conditioning device, including a plurality of microporous barriers and microporous films, in accordance with an embodiment disclosed herein.
Figure 2B:
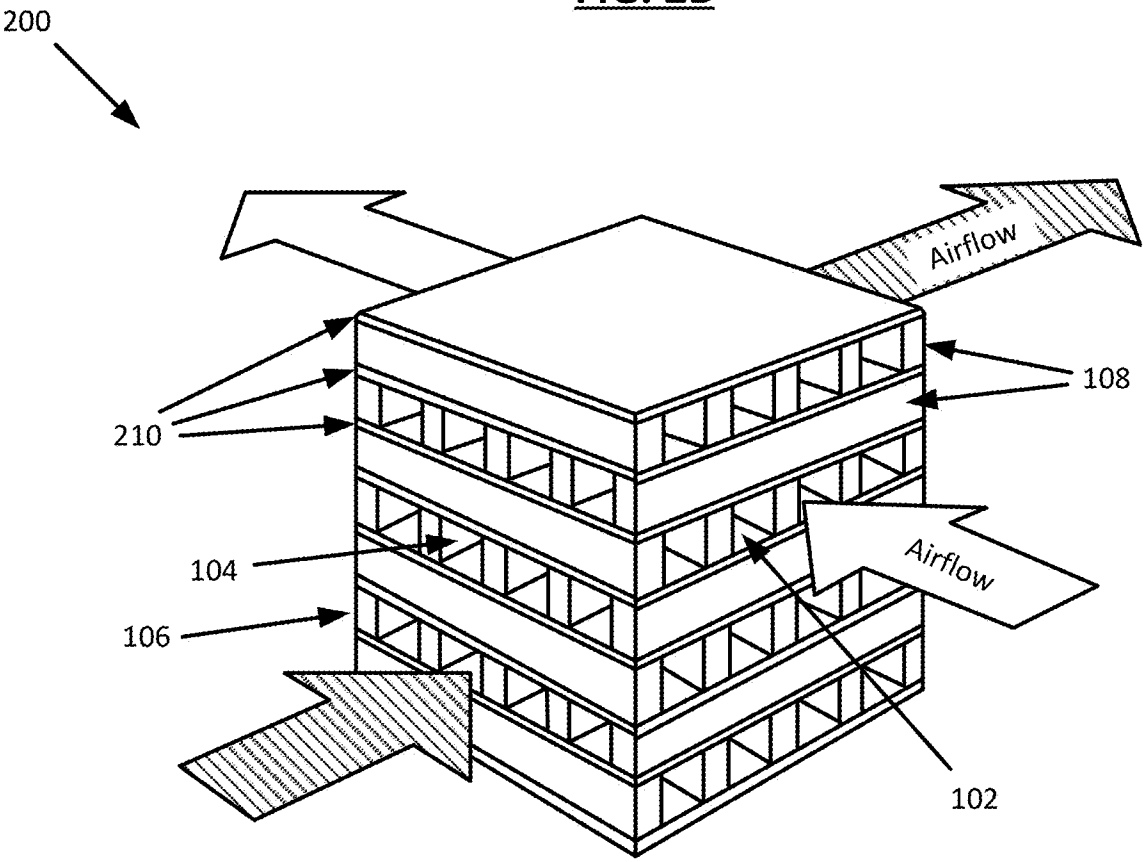
FIG. 2B is an example airflow conditioning device, in accordance with another embodiment disclosed herein.

FIG. 2A is a cross-sectional illustration of an airflow conditioning device 200 according to embodiments disclosed herein. The airflow conditioning device 200 includes a plurality of air-permeable barriers 210. The air-permeable barriers 210 each includes at least one substrate 202, at least one coating 204, and at least one microporous film 220. As shown, the airflow conditioning device 200 may be arranged inclusively between at least a first channel 102 defining a first airflow pathway through the airflow conditioning device 200 and a second channel 104 defining a second airflow pathway through the airflow conditioning device 200. In certain instances, the first channel 102 may be configured to direct a first airflow and the second channel 104 configured to direct a second airflow through the airflow conditioning device 200.

FIG. 2B shows the airflow conditioning device 200, in accordance with an embodiment disclosed herein, where the cross-sectional shape of the channels 102 and 104 is rectangular. The spacers 108 may be used as support elements for separating and defining the distance between adjacent barriers 210. For example, some of the spacers or support elements 108 may be used to maintain a separation distance of $h_1$ between two adjacent barriers 210 (e.g., upper and middle barriers), or a separation distance of $h_2$ between two other adjacent barriers 210 (e.g., middle and lower barriers), as shown in FIG. 2A, in forming the heat and moisture exchanger 106.

In certain instances, the microporous film 220 may be an ePTFE microporous film, an ePE microporous film, or a combination thereof, although a variety of polymeric materials are contemplated. The microporous film 220 may be adjoined to a substrate 202. In some examples, the substrate may by a mesh or mesh component. In certain instances, the microporous film 220 is heat laminated to an extruded mesh component. In addition, the microporous film 220 may be a component of a nonwoven fabric. In other instances, the microporous film 220 may be dot laminated to a nonwoven fabric. In FIG. 2A, microporous film 220 is illustrated as embodying the aforementioned film with an exemplary mesh and/or fabric component. It should be appreciated that the illustrated microporous film 220 may be a single layer of an ePTFE microporous film or a single layer of an ePE microporous film, for example. As also illustrated in FIG. 2A, the microporous film can include a coating 204 that limits or enhances porosity or the transfer of thermal energy or moisture transfer. The coating 204 may limit the porosity but does not make the surface of the air-permeable barrier 210 (on which the coating is applied) to be nonporous. Similarly, the aforementioned coating can be applied to the mesh and/or fabric either as a single coating layer or in combination with multiple coating layers.

The microporous film 220 may include a topography that improves moisture exchange with minimal increase in pressure drop or fan energy inclusively between the channels 102, 104. The microporous film 220 may include an open knit or woven structure or extruded mesh structures to facilitate latent energy transfer. In certain instances, the microporous film 220 may have a structure configured to include a thermal conductivity that improves heat transfer. The microporous film 220 may have a high latent energy transfer (e.g., inclusively between the air flow exchanged in the channels 102, 104) in certain instances. The high latent energy transfer may include inclusively between 60% and 75% heat transferred inclusively between the air flows within the channels 102, 104. Heat transfer inclusively between the air flows occurs across the barrier formed by the microporous film 220.

In certain instances, the microporous film 220 includes a high porosity (e.g., inclusively between 60% and 90%), a leak rate (e.g., inclusively between about 0.5% and about 3.0%), and a latent energy transfer (e.g., inclusively between about 65% and about 80%). In other instances, the microporous film 220 includes a porosity (e.g., inclusively between 60% and 90%), a leak rate (e.g., inclusively between about 0.5% and about 3.0%), and a latent energy transfer (e.g., inclusively between about 65% and about 80%). Further, the microporous film 220 may include a leak rate (e.g., inclusively between about 0.5% and about 3.0%) and a latent energy transfer (e.g., inclusively between about 65% and about 80%) in certain instances.

The substrate 202, in certain instances such as when the substrate 202 is an extruded or woven mesh, includes a plurality of strands or fibers that includes inclusively between about 3 to about 16 strands per inch. A thickness of the substrate 202 may be inclusively between about 0.01 mm and about 3 mm. Further, the microporous film 220 may be disposed on the substrate 202 to form a microporous or air-permeable barrier 210 (e.g., one of the series of barriers as described above with reference to FIGS. 1 and 2B, and as shown in FIG. 2A). The microporous film 220 and barrier 210 may define a latent efficiency of the airflow conditioning device 200 with the efficiency inclusively between about 75% and about 80% at a Re value of inclusively between 50 and 85 as described in further detail with reference to FIG. 3. In addition, the microporous film 220 may also define moisture transport parameter across the at least one of the series of barriers.

The microporous film 220 may be used in methods for conditioning an airflow passing through an airflow conditioning device, for example, such as an Air-to-Air Energy Recovery Ventilator or Dedicated Outdoor Air Supply. A first airflow and a second airflow may be directed through the airflow conditioning device 200 through the channels 102, 104 with each of the airflows being directed a heat exchanger disposed (e.g., including the microporous film 220 as shown in FIG. 2A) within the airflow conditioning device 200. The first and second airflows each passing through the heat exchanger with a controlled transfer of heat and moisture. In addition, the microporous film 220 may form one of a series of barriers separating the first airflow from the second airflow. In certain instances, the content and construction of the microporous film 220 may be altered to optimize use in the airflow conditioning device. For example, a different composition of the microporous film 220 may be used for winter versus summer or different humidity levels in different climates. The microporous film 220 may optimize exchange moisture transfer without limiting air flow.

In certain instances, the barrier 210 may include a geometry and surface roughness that lowers a thickness of the stagnant air boundary layer at the surfaces of the barrier 210 which includes the microporous film 220. The barrier 210, for example, may include a substantially rectangular shape, a shape with peaks and valleys, a triangular shape, or any shape that would facilitate heat exchange. In addition, the barrier 210 may include a roughness characterized by having a plurality of microridges or microstructures spread across a surface of the barrier 210.

Figure 3:
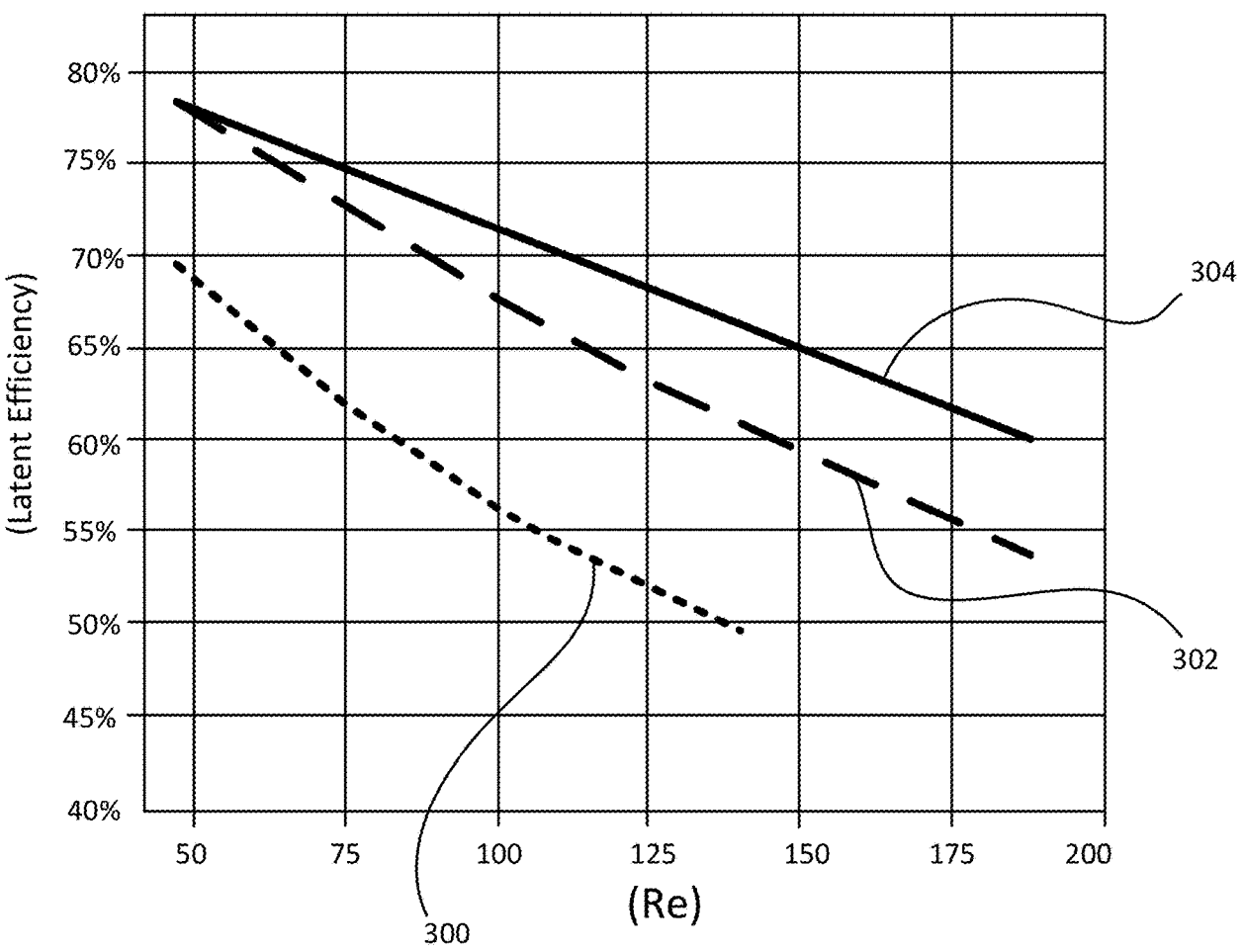
FIG. 3 is example data showing performance of an example airflow conditioning device, consistent with various aspects of the present disclosure, and prior airflow conditioning devices, in accordance with an embodiment.

FIG. 3 is example data showing performance of an example airflow conditioning device, consistent with various aspects of the present disclosure, and prior airflow conditioning devices, in accordance with an embodiment. The data shows an example of latent efficiency (e.g., effectiveness to transfer moisture across a barrier such as a microporous film 220) of example airflow conditioning devices, consistent with various aspects of the present disclosure in comparison with prior airflow conditioning devices.

The latent efficiency of an example prior airflow conditioning device is shown in curve 300 alongside two example airflow conditioning device, consistent with various aspects of the present disclosure, represented by curve 302 and curve 304. Curve 302 defines the measurement for a barrier 210 with 200, 202, 220. Curve 304 defines the measurement for a barrier 210 with only 200 and 220. The Reynolds Number (Re) relates to fan energy required to move air across the barrier plate arranged with the airflow conditioning devices. As shown in comparing the curve 300 to curves 302, 304, the two example airflow conditioning devices, consistent with various aspects of the present disclosure outperform the example prior airflow conditioning device. In most instances, the two example airflow conditioning devices, consistent with various aspects of the present disclosure, outperform the example prior airflow conditioning device by inclusively between about 20% to about 35%. The curves 302, 304 show a latent efficiency of at least 70% at a Re value of inclusively between 50 and 85. In some examples, the latent efficiency of at least 70% may be achieved at a Re value of between 50 and 55, between 55 and 60, between 65 and 70, between 70 and 75, between 75 and 80, between 80 and 85, or any other suitable range (or combination of ranges) or number therebetween.

Figure 4A:
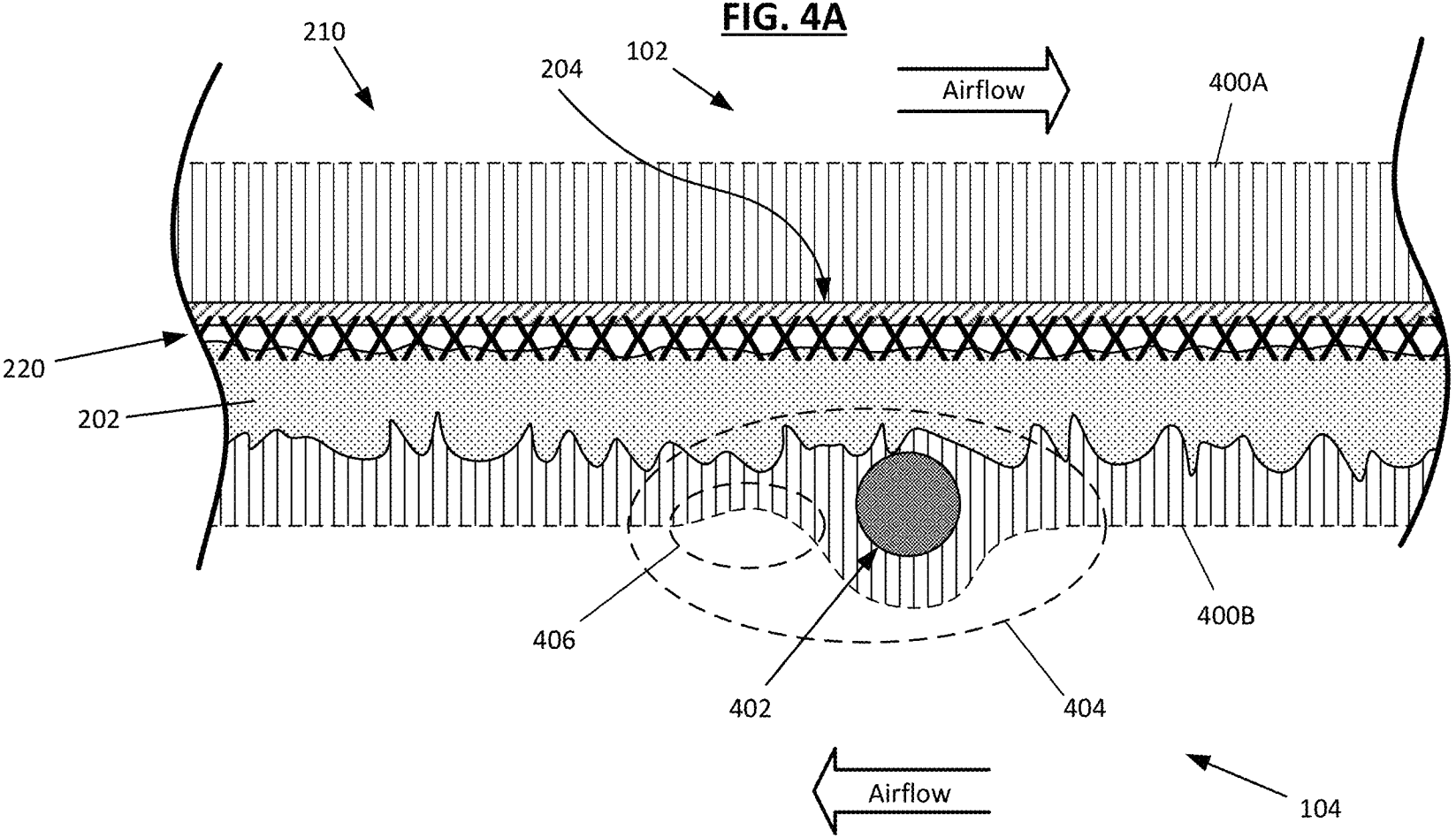
FIGS. 4A and 4B are cross-sectional illustrations of an example airflow conditioning device and microporous film and spacer, in accordance with embodiments disclosed herein.
Figure 4B:
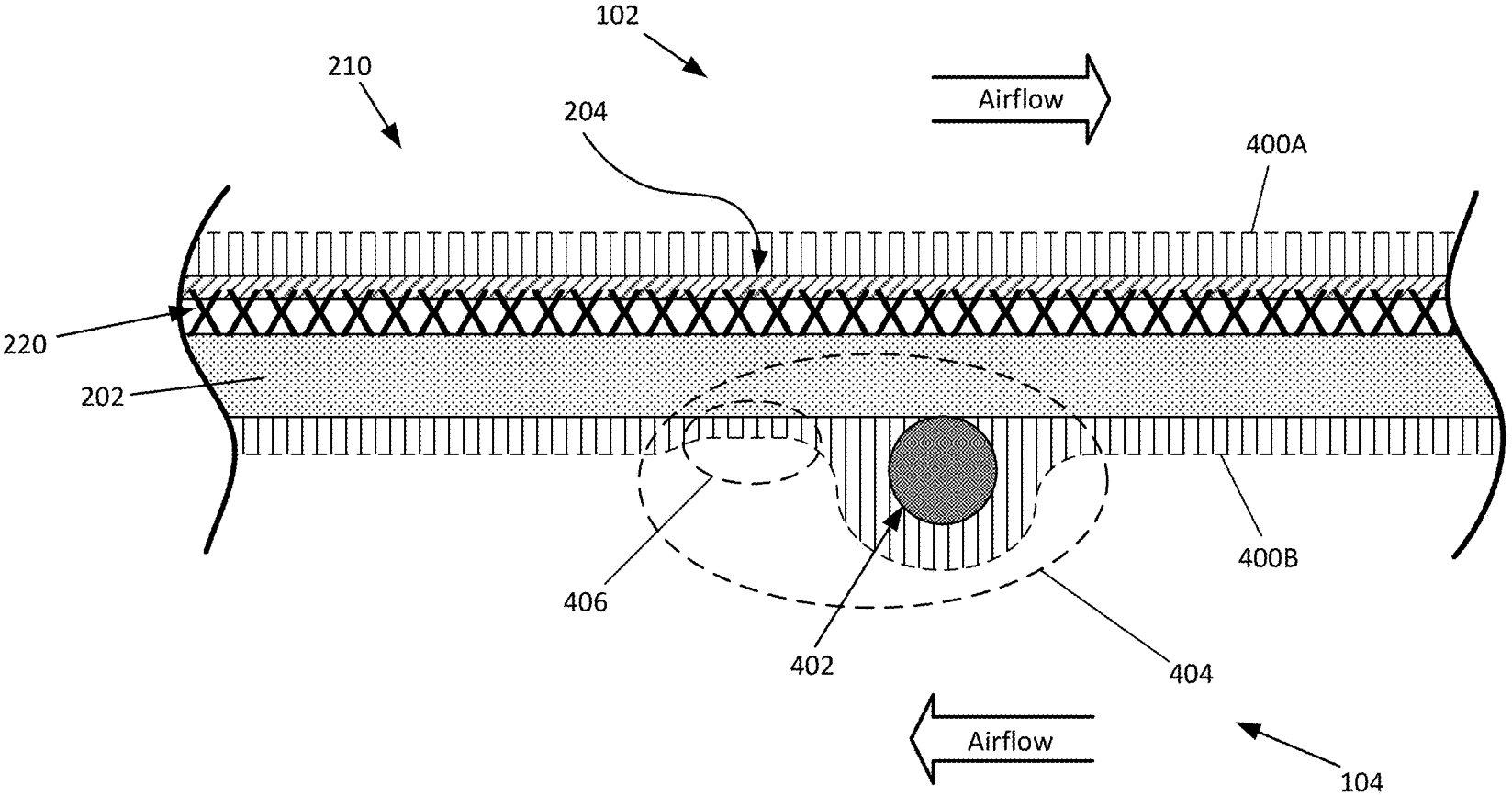

FIGS. 4A and 4B are a cross-sectional views of the microporous barrier 210 of an airflow conditioning device 200 according to examples disclosed herein. The airflow above (e.g., the airflow through the channel 102) and below (e.g., the airflow through the channel 104) the barrier 210 are illustrated. As the airflow travels across the surfaces of the barrier 210, a boundary layer 400 can develop along those surfaces. As shown, an upper boundary layer 400A is formed on an upper surface with respect to the coating 204, and a lower boundary layer 400B is formed on a lower surface with respect to the substrate 202. The boundary layer 400 creates a layer of resistance to the heat and moisture transfer through the barrier 210 from the first airflow pathway (e.g., 102) to the second airflow pathway (e.g., 104). The heat and water vapor transfer resistance in the boundary layers (e.g., 400A and 400B) can have a significant effect on the overall latent and sensible effectiveness of the device. In some examples, the inclusion of a spacer 402 at the surface of the barrier 210 has the effect of perturbing or disrupting the airflow (in the examples shown, the airflow through the channel 104) and the development of the boundary layer (in the examples shown, the boundary layer 400B). This has the positive effect of reducing the heat and water vapor transfer resistance in the boundary layer. As a result, spacers can be configured along the surfaces of the barriers in the device to enhance the water vapor and heat transfer between the first and second airflows resulting in the device having higher latent and sensible effectiveness with a minimal increase in fan energy.

In FIG. 4A, the boundary layer 400B that is formed is thicker based on the configuration of the substrate 202. That is, the substrate 202 may be formed as an extruded or woven mesh, in which case the surface of the substrate 202 increases (or more specifically, the unevenness of the surface increases), thereby forming a thinner boundary layer 400B than in FIG. 4B. FIG. 4B shows the boundary layer 400B based on a smoother surface of the substrate 202, such as a structurally uniform layer of substrate material which forms a relatively flat surface as shown. The resulting boundary layer 400B, therefore, is generally thicker than the corresponding boundary layer for the extruded or woven mesh, for example. In both of these examples, the spacer 402 perturbs or disrupts the development of the boundary layer 400B by first creating a disruption region 404 surrounding the spacer 402, which creates the boundary layer 400B immediately surrounding the spacer 402 to increase in thickness, but at a certain distance past the initial increase in thickness, a thinner region 406 is formed within the disruption region 404, as shown. The thinner region 406 is formed due to a turbulence in the airflow through the channel 104 as air flows past the spacer 402, during which the disruption causes the chaotic changes within the disruption region 404 to result in a reduced thickness of the thinner region 406.

Figure 5A:
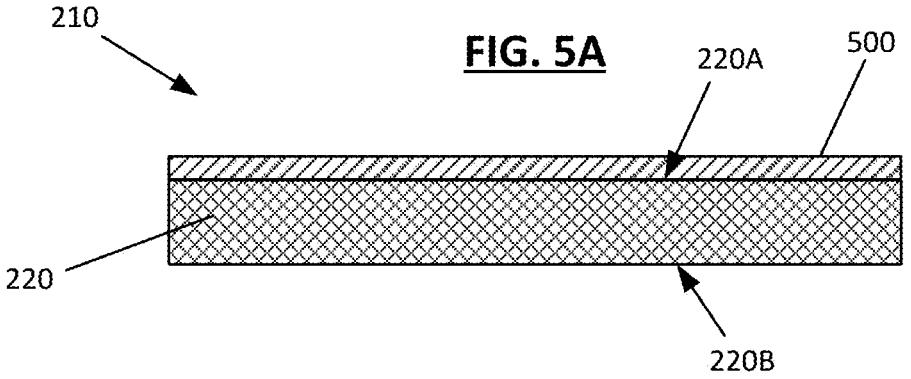
FIGS. 5A through 5G are cross-sectional illustrations of an example microporous barrier with different examples of continuous and discontinuous coatings, in accordance with embodiments disclosed herein.
Figure 5B:
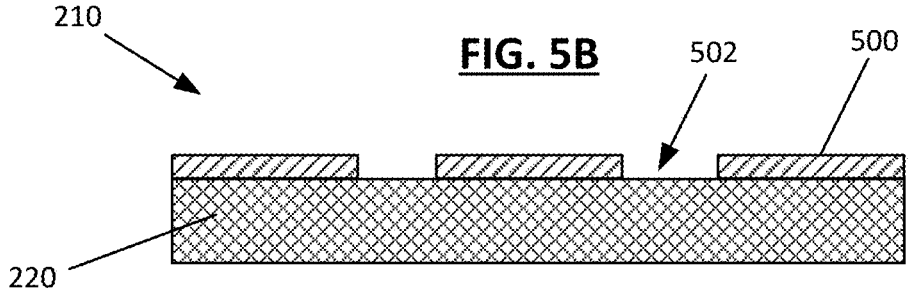
Figure 5C:
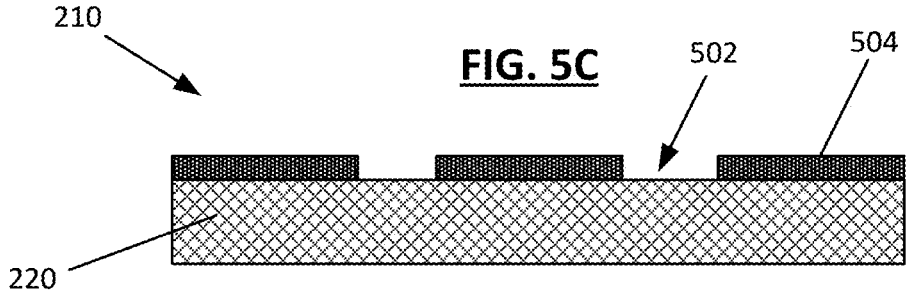

FIGS. 5A through 5G illustrate different examples of the microporous barrier 210 which may be implemented in some configurations. Each microporous film 220 may include a first surface 220A and a second surface 220B. For example, FIG. 5A shows the microporous barrier 210 in which an entire surface of the microporous film 220 is coated continuously with a microporous coating 500. FIG. 5B shows the microporous barrier 210 in which the surface of the microporous film 220 is partially or discontinuously coated with the microporous coating 500, with uncoated regions 502 showing the bare surface of the microporous film 220. FIG. 5C shows the microporous barrier 210 in which the surface of the microporous film 220 is partially or discontinuously coated with a nonporous coating 504, with the uncoated regions 502 thereof being the only regions on the surface of the microporous film 220 that is effectively microporous.

Figure 5D:
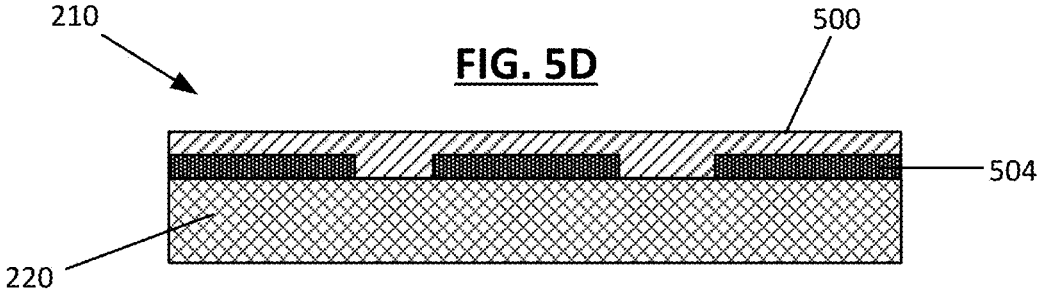
Figure 5E:
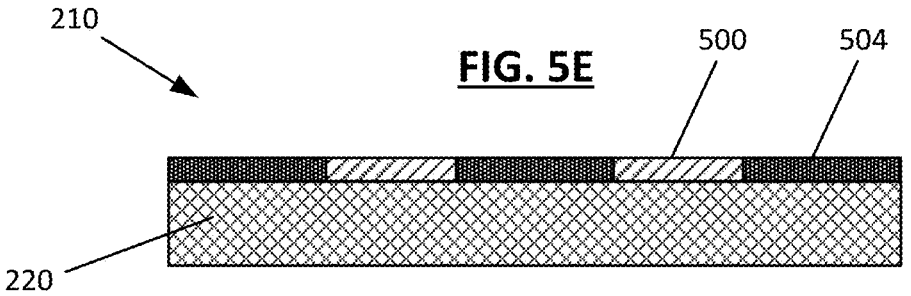

FIG. 5D shows the microporous barrier 210 of FIG. 5C with another layer of coating applied. In this example, the microporous coating 500 is applied continuously on the entire surface of the microporous film 220, that is, over both the nonporous coating 504 and the uncoated regions 502. Although the microporous coating 500 does not affect the porosity of the region where the nonporous coating 504 is already applied, in some examples, the microporous coating 500 can provide protection for the surface of the microporous film 220 because there is no uncoated region 502. In this respect, the microporous barrier 210 of FIG. 5E has a similar property with respect to that of FIG. 5D, because the microporous coating 500 is applied to fill in the gaps between the regions on the surface of the microporous film 220 where the nonporous coating 504 is discontinuously applied.

Figure 5F:
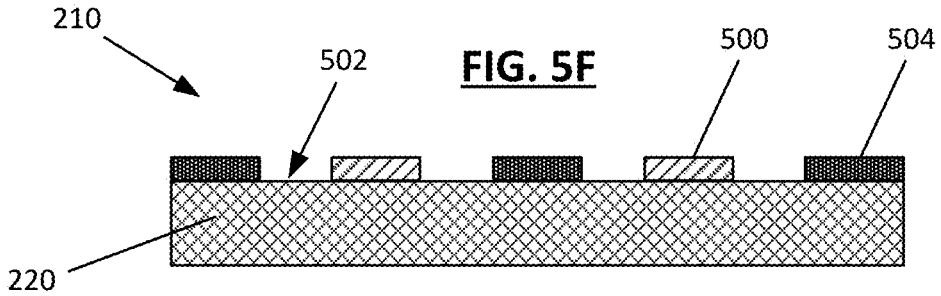

FIG. 5F shows the microporous barrier 210 with both the microporous coating 500 and the nonporous coating 504 applied discontinuously or partially on the surface of the microporous film 220, thereby leaving uncoated regions 502 of the surface. In this case, another layer of coating, similar to the microporous coating 500 of FIG. 5D, may be applied to fill the uncoated regions 502 with microporous coating material, as suitable.

Figure 5G:
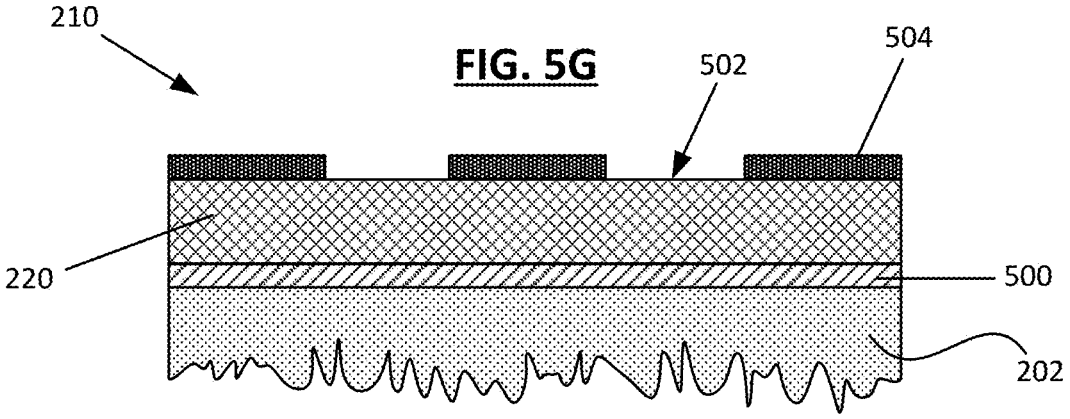

FIG. 5G shows the microporous barrier 210 with both surfaces of the microporous film 220 covered with coating. The coating may be a discontinuous coating of the nonporous coating 504, a discontinuous coating of the microporous coating 500, a continuous coating of the microporous coating 500, or any combination thereof. In the example as shown, one surface (the top surface) of the microporous barrier 210 is coated discontinuously with the nonporous coating 504 while the other surface (the bottom surface) of the microporous barrier 210 is coated continuously with the microporous coating 500 before the substrate 202 is affixed on the coating 500 to form the microporous barrier 210.

Figure 6A:
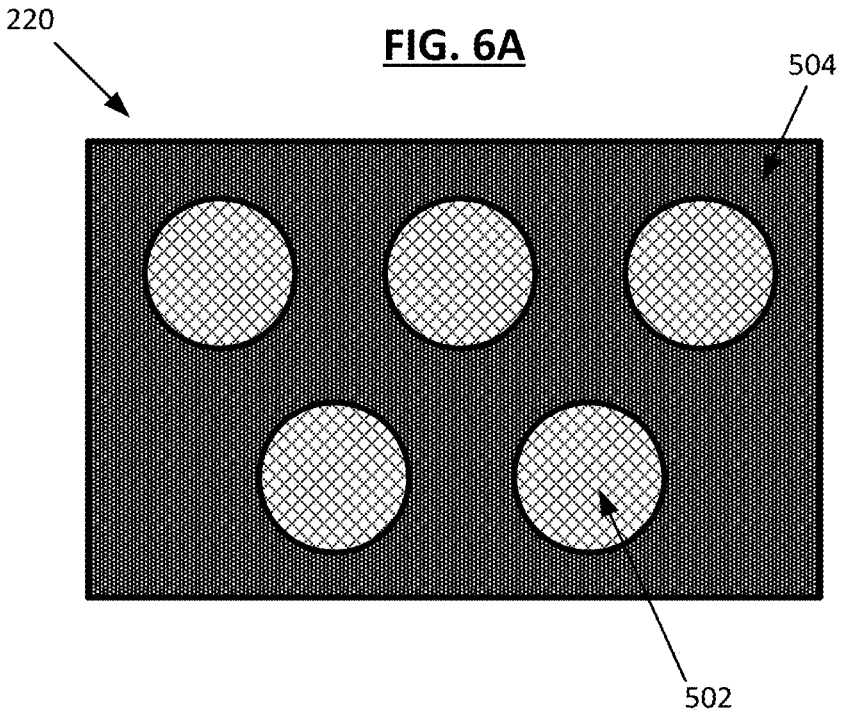
FIGS. 6A through 6C are illustrations of a surface of an example microporous barrier with different examples of discontinuous coating, in accordance with embodiments disclosed herein.
Figure 6B:
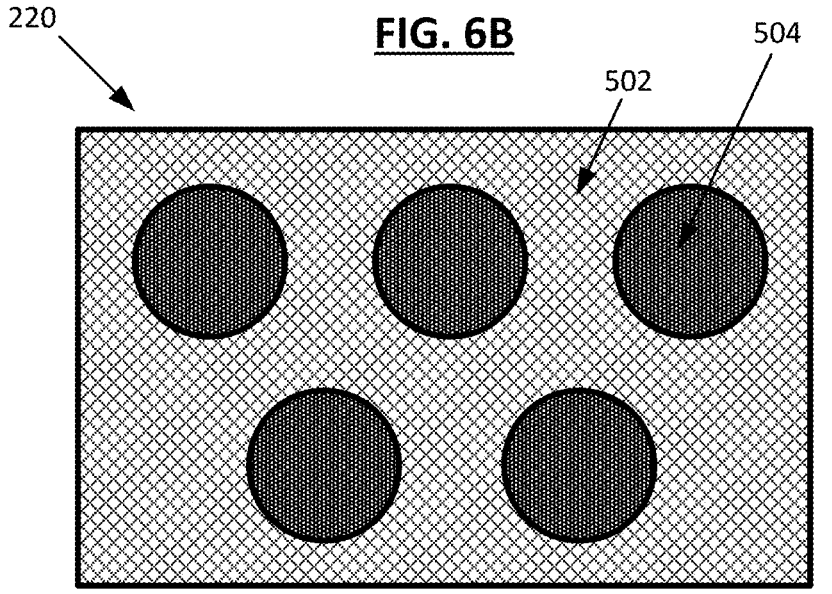
Figure 6C:
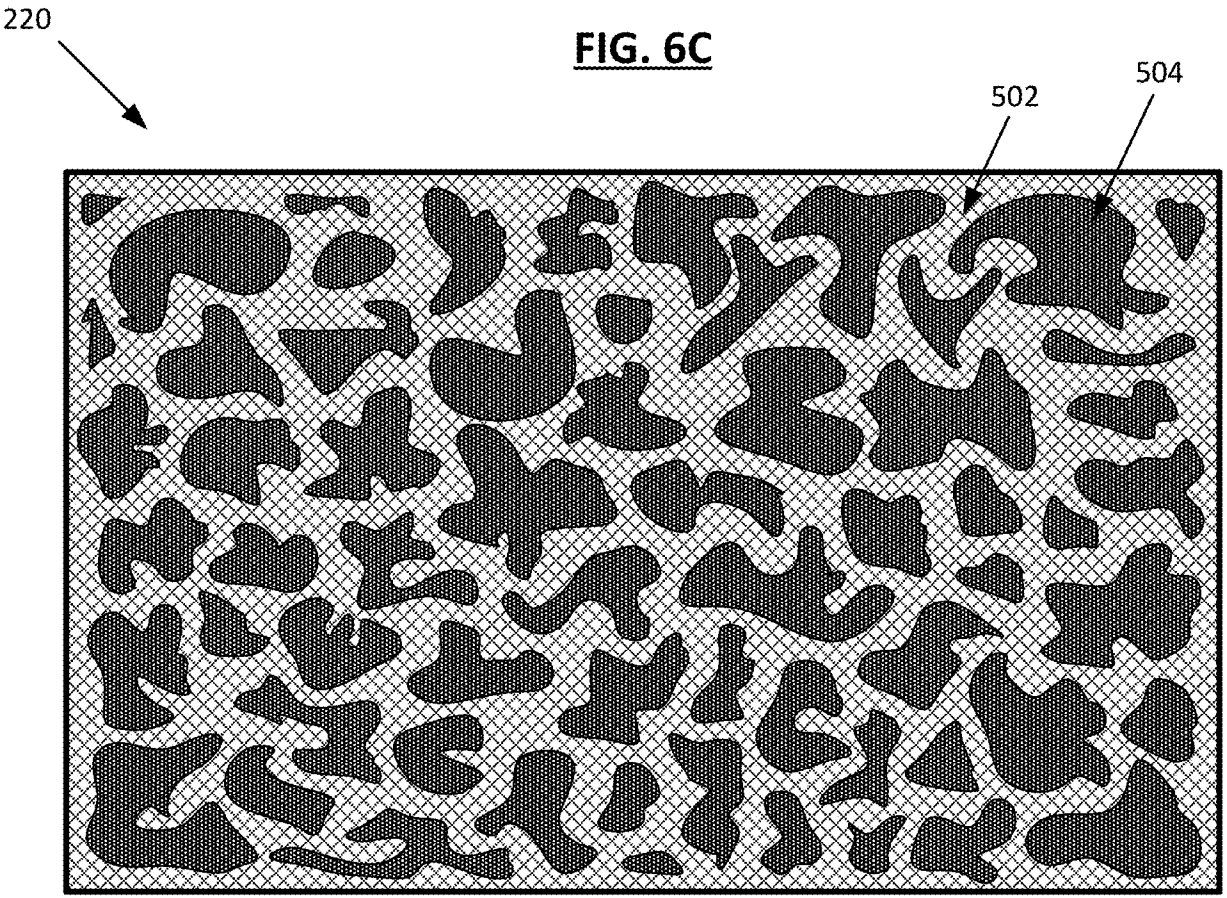

FIGS. 6A through 6C show a few examples of how a discontinuous coating may be applied on the surface of the microporous film 220. In FIG. 6A, the nonporous coating 504 (although it is understood, as explained above, that the coating may be microporous as well) is applied to leave sections of the surface uncoated, forming the uncoated region 502. The uncoated regions 502 may be distributed or dispersed uniformly or evenly, and/or having a similar configuration, such as shape and/or size, with respect to each other, for example. In other words, the uncoated regions 502 are not concentrated on one area or region with respect to the entire surface of the microporous film 220 in such a way as to cause insufficient uniformity in the distribution of such uncoated regions 502 throughout the surface of the microporous film 220.

FIG. 6B shows an inverse of FIG. 6A, where the coating is applied in individual sections such that each application of the nonporous coating 504 forms an "island" that is separated from other islands by the uncoated region 502. In this case, the nonporous coating 504 may be applied uniformly such that the "islands" may be distributed sufficiently evenly across the surface of the microporous film 220.

FIG. 6C shows the "island" configuration of nonporous coating 504 as shown in FIG. 6B, but without the uniformity in the shape of each "island." That is, the shape or size of the "islands" may appear random, for example with no discernable pattern in terms of the shape or configuration of each island, but they are distributed sufficiently evenly or uniformly across the entire surface of the nonporous film 220. In contrast, a nonuniform or uneven distribution would be, for example, the left half of the surface of the nonporous film 220 having all the discontinuous coating applied thereon, while the other half (the right half) having no such coating, thereby formed entirely of the uncoated region 502.

Figure 7:
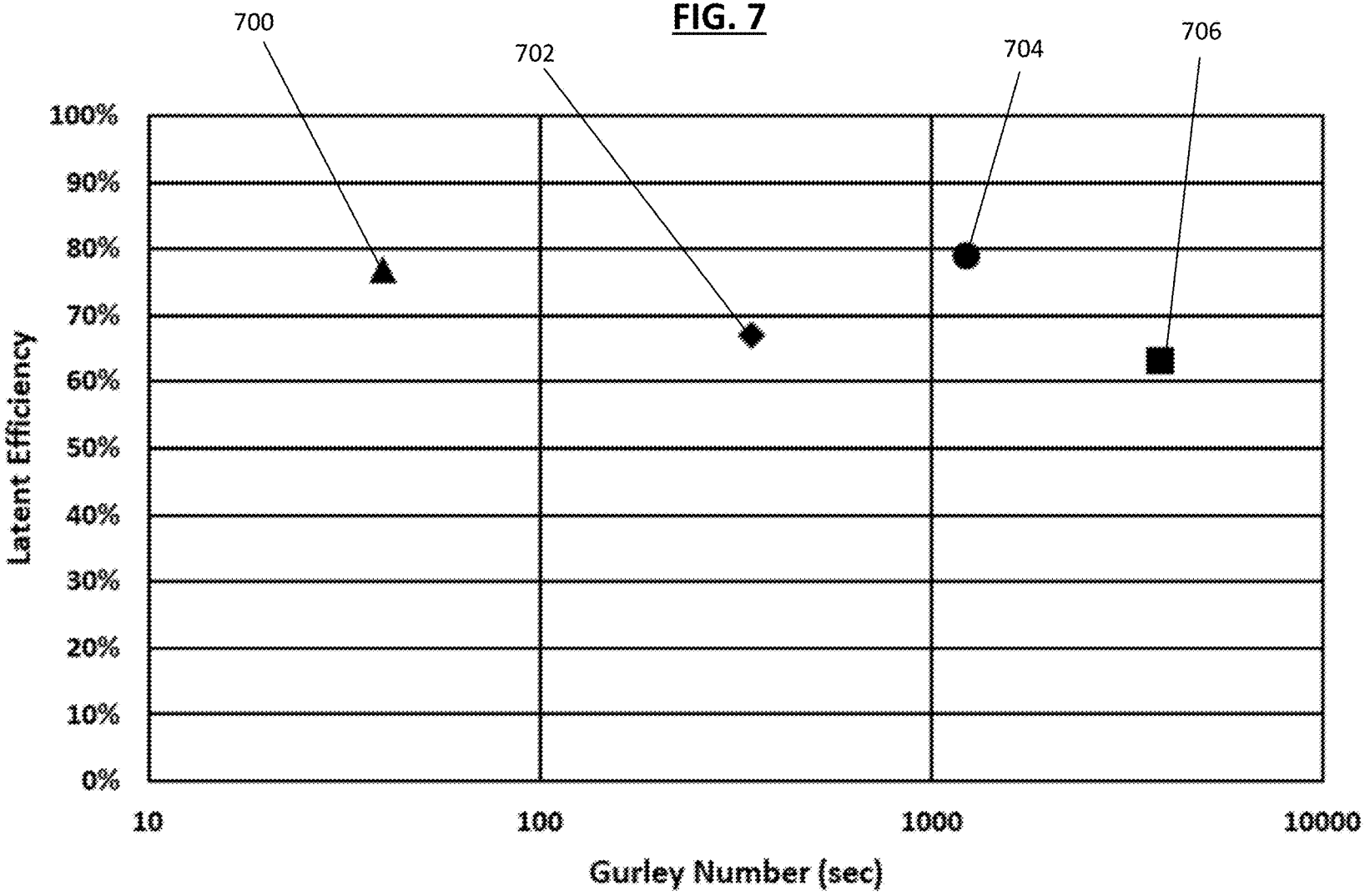
FIG. 7 is a graph illustrating the relationship between latent efficiency and the Gurley number, comparing the coating in accordance with embodiments with other film materials as known in the art.

FIG. 7 shows a chart which compares the latent efficiency and Gurley number of four distinct samples 700, 702, 704, and 706 for implementing as one of the microporous or air-permeable barriers 210 as explained herein. Sample 700 is a microporous ePTFE membrane having a thickness of about 20 μm, a porosity of about 65.4%, and a pore size of about 0.15 microns. The ePTFE membrane has a Gurley air permeability of about 40 seconds and a latent efficiency of about 77% at an airflow rate of 0.2 liter/min. Sample 702 is a microporous ePTFE membrane having a thickness of about 28 μm, a porosity of about 85%, and an air permeability of about 3.5 Gurley seconds, which was coated with a polyurethane-based coating containing $TiO_2$ particles. The coating has a thickness of about 1.3 μm. The coated ePTFE membrane has an air permeability of about 350 Gurley seconds and a latent efficiency of about 67% at an airflow rate of 0.2 liter/min. Sample 704 is a microporous ePTFE membrane having a thickness of about 20 μm, a porosity of about 65.4%, and a pore size of about 0.15 μm. The ePTFE membrane has a Gurley air permeability of about 40 seconds. A polyurethane based coating containing $TiO_2$ filler particles was applied to this ePTFE membrane using a Mayer rod coating method to produce a coating thickness of about 4 μm. The coated ePTFE membrane has an air permeability of about 1230 Gurley seconds and a latent efficiency of about 79% at an airflow rate of 0.2 liter/min. Sample 706 is a microporous ePTFE membrane having a thickness of about 28 μm, a porosity of about 85%, and an air permeability of about 3.5 Gurley seconds, which was coated with a polyurethane-based coating containing $TiO_2$ particles. The coating layer has a thickness of about 1.3 μm. The coated ePTFE membrane has a Gurley air permeability of about 3850 seconds and a latent efficiency of about 63% at an airflow rate of 0.2 liter/min.

The table (Table 1) below visually compares the values of flowrate, Gurley number, and latent effectiveness of these samples as experimentally measured. As can be observed, the sample without any coating (sample 700) has a significantly lower Gurley number as compared to those with a coating applied on the surface, with at least a 775% increase in Gurley number from the uncoated sample and the lowest Gurley number measured among the coated samples (sample 702). According to examples disclosed herein, at least one of the barriers 210 has an air permeability between 300 and 500 Gurley seconds, 500 and 700 Gurley seconds, between 700 and 1000 Gurley seconds, between 1000 and 1500 Gurley seconds, between 1500 and 2000 Gurley seconds, between 2000 and 3000 Gurley seconds, between 3000 and 4000 Gurley seconds, between 4000 and 5000 Gurley seconds, or any other suitable value or range therebetween.

TABLE 1

Comparison of material properties of sample membranes with and without coating of various types.

| Sample No. | Flowrate (L/min) | Gurley No. (sec) | Latent Efficiency (%) |
|---|---|---|---|
| 700 | 0.2 | 40 | 76.9% |
| 702 | 0.2 | 350 | 67.0% |
| 704 | 0.2 | 1232 | 79% |
| 706 | 0.2 | 3850 | 63.0% |

Figure 8:
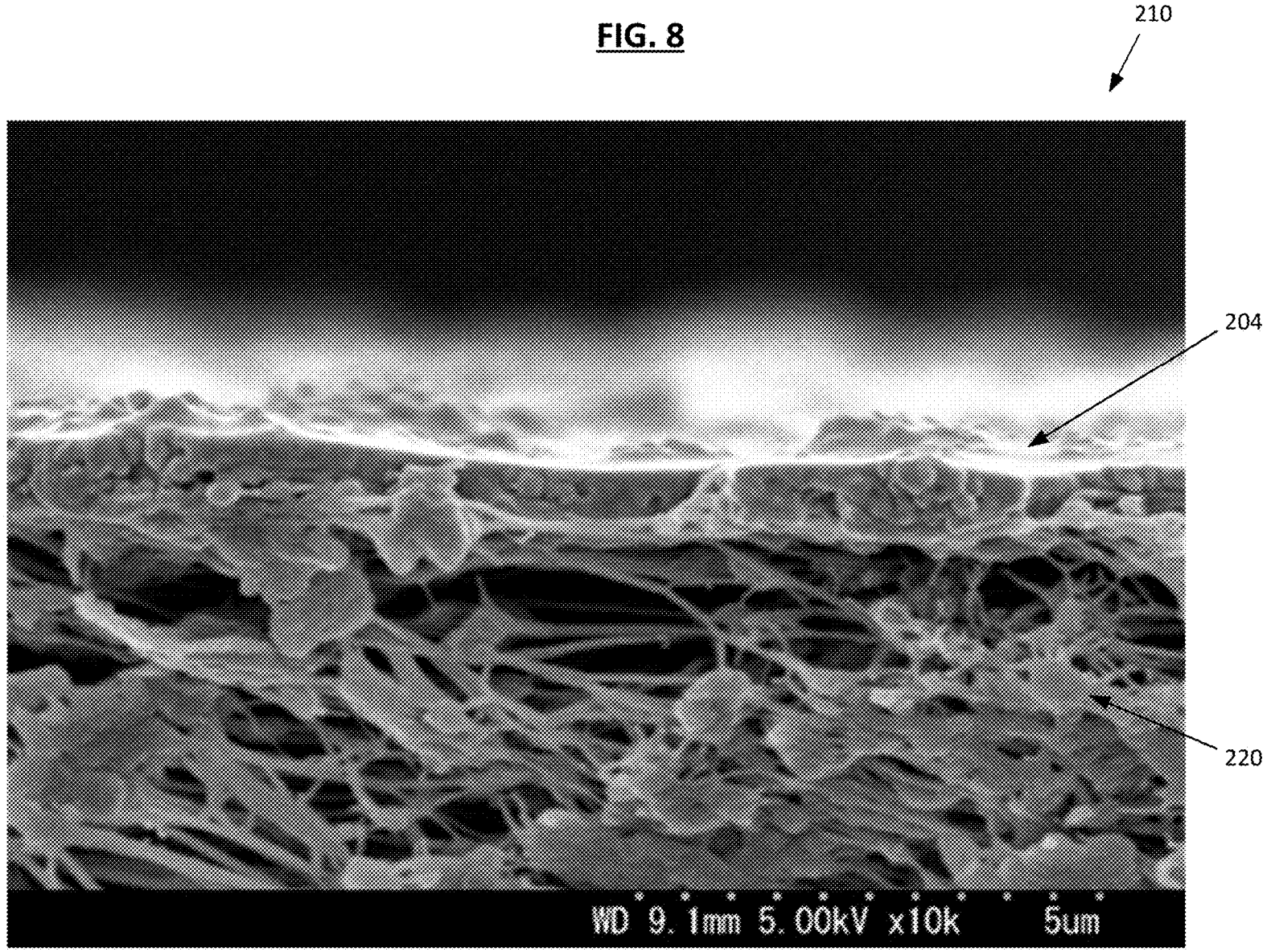
FIG. 8 is a scanning electron microscope (SEM) image of a cross-sectional view of a microporous barrier, in accordance with embodiments disclosed herein.

FIG. 8 is a scaled scanning electron microscope (SEM) image of a cross-sectional view of the microporous barrier 210 of the airflow conditioning device 200 according to an example. The barrier 210 includes the coating 204 disposed on an outer surface of the microporous film 220, and the coating 204 may entirely or partially cover the surface of the microporous film 220 as explained herein. The SEM image is scaled at a 10,000× magnification with a scale showing the length of 5 μm relative to the image (such that a distance between two consecutive dots represents 0.5 μm, or 500 nm). Indicated at the bottom of the image are: WD, 9.1 mm, 5.00 kV, ×10 k, 5 μm.

Figure 9:
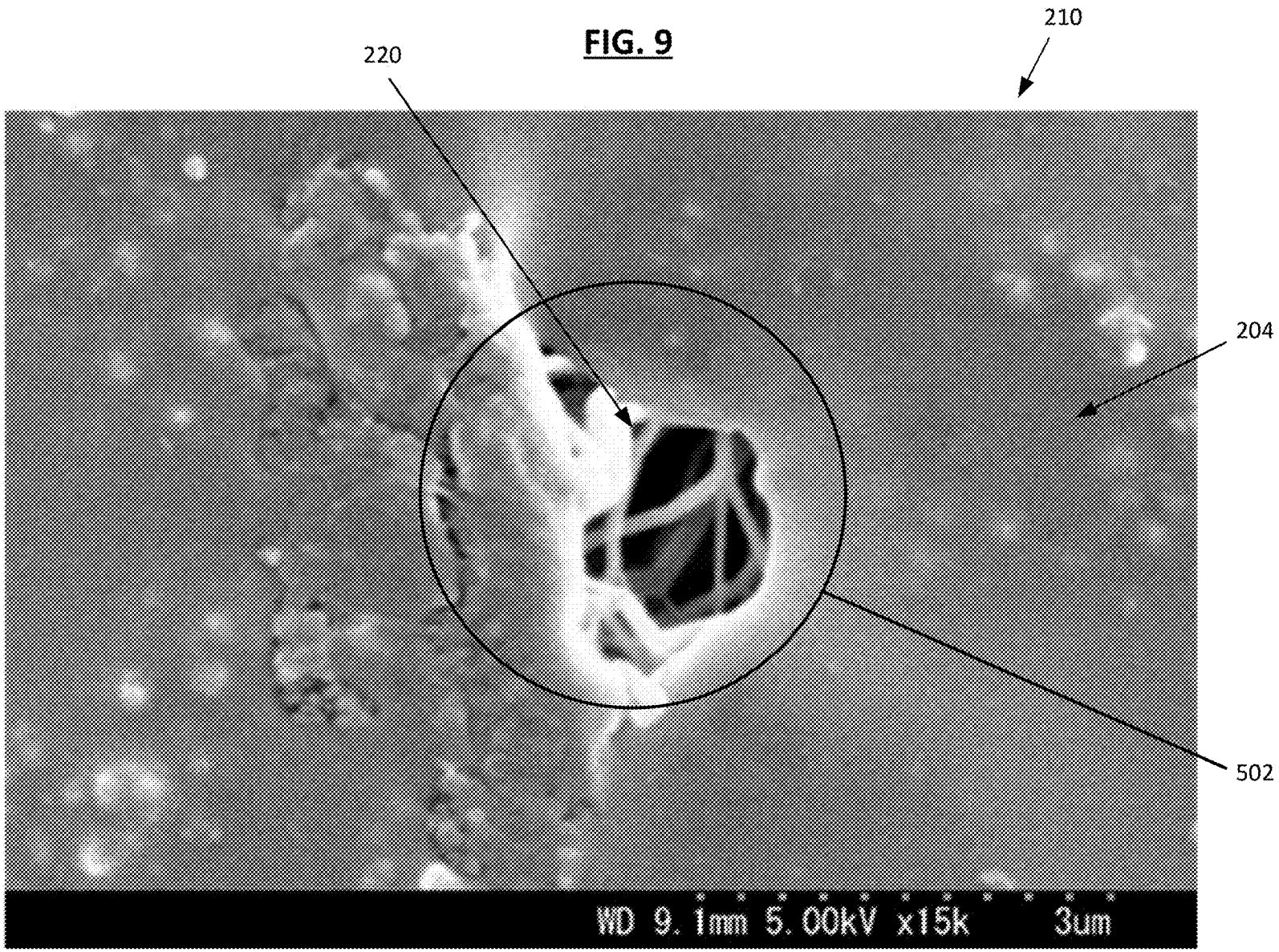
FIG. 9 is an SEM image of a top view of a microporous barrier, in accordance with embodiments disclosed herein.

FIG. 9 is a scaled SEM image of a top view of the microporous barrier 210 of the airflow conditioning device 200 according to an example. The coating 204 is a discontinuous coating disposed on the surface of the microporous film 220 to form the barrier 210 such that a portion of the microporous film 220 can be seen through an opening defined by an uncoated region 502 (circled) of the coating 204. As explained herein, the discontinuous coating may be either a discontinuous microporous coating or a discontinuous nonporous coating. The SEM image is scaled at a 15,000× magnification with a scale showing the length of 3 μm relative to the image (such that a distance between two consecutive dots represents 0.3 μm, or 300 nm). Indicated at the bottom of the image are: WD, 9.1 mm, 5.00 kV, ×15 k, 3 μm.

TEST METHODS

It should be understood that although certain methods and equipment are described below, other methods or equipment determined suitable by one of ordinary skill in the art may be alternatively utilized.

A latent efficiency ($E_{lat}$) of the microporous barrier material is a measurement of the amount of water vapor that permeates through the barrier material from a moister air stream to a drier air stream where the two air streams are separated by the microporous barrier material. Measuring the latent efficiency of a microporous barrier material can be achieved using the test system shown in FIG. 10 and using Equation 1 below:

$$E_{lat} = \frac{(M_{in,1} - M_{out,1}) + (M_{out,2} - M_{in,2})}{2 * (M_{in,1} - M_{in,2})} * 100\% \quad \text{(Equation 1)}$$

where $M_{in,1}$ is the moisture content in the air transferring into the barrier (e.g., the middle barrier 210 in FIG. 2A) from the first side (e.g., upper channel 102), $M_{out,1}$ is the moisture content transferring out from the first side, $M_{in,2}$ is the moisture content transferring into the second side (e.g., lower channel 104), and $M_{out,2}$ is the moisture content transferring out from the second side.

Figure 10:
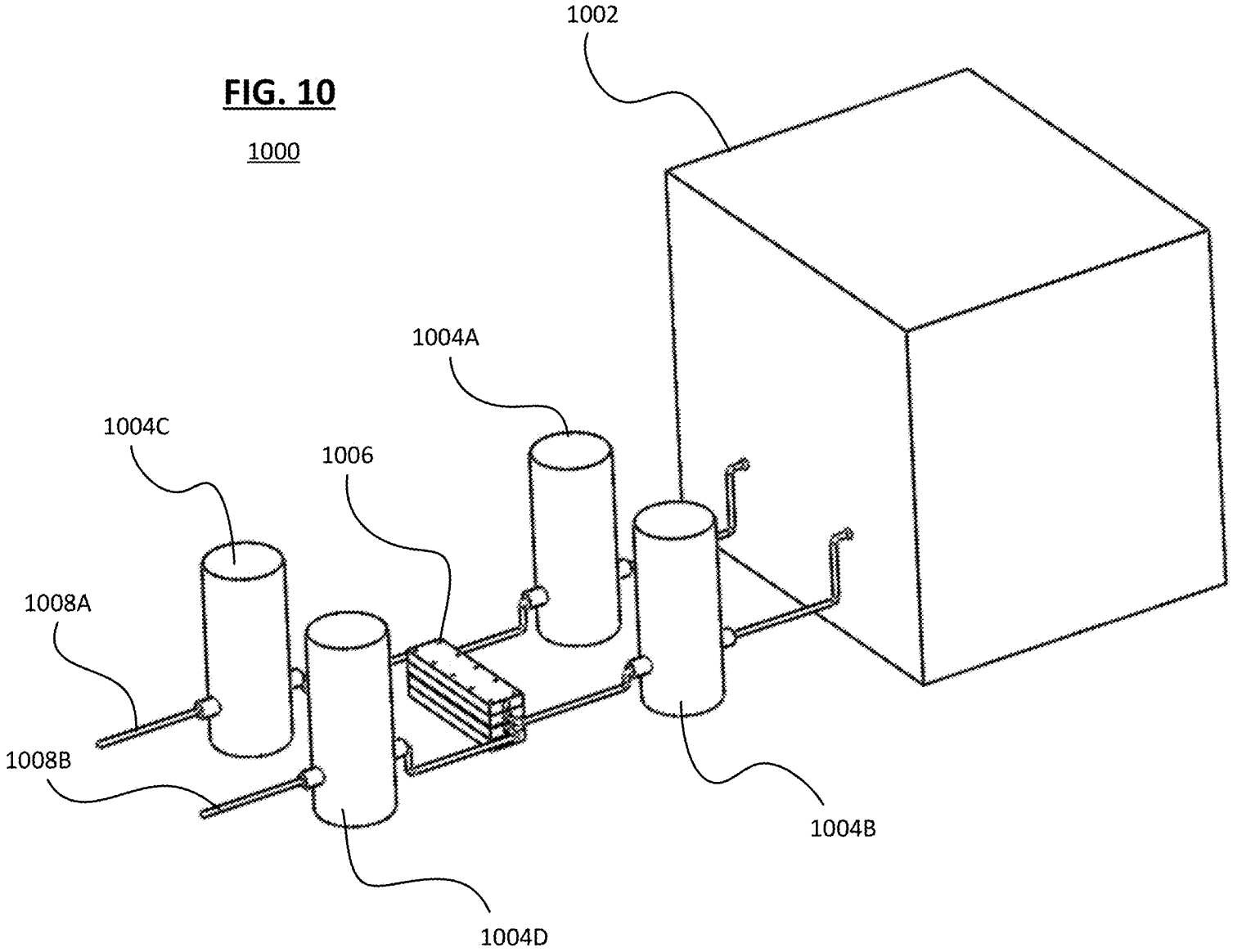
FIG. 10 is a schematic view of a latent efficiency test system which may be implemented to perform tests to measure latent efficiency of an object.

Referring to FIG. 10, an example of a test system 1000 for measuring a latent efficiency of a test sample material includes the following: a suitable test load instrument such as a Scribner Fuel Cell Test Load Instrument 1002 (for example, Model 840 may be implemented, although any suitable model may be employed as appropriate to perform such tests), a set of chilled mirror hygrometers 1004 (shown as a set of four hygrometers 1004A, 1004B, 1004C, and 1004D), a test cell 1006 including the test sample material, and exhaust drain 1008 from which the condensate may be drained from the system 1000.

The instrument 1002 is used to control the air flow rates, humidity levels in the air flow streams, the temperature of the air flow streams, and the temperature of heating elements (not shown) of the test cell 1006. The hygrometers 1004 are used to measure the dew point of the air at each of airflow inlets and outlets of the test cell 1006.

Figure 11A:
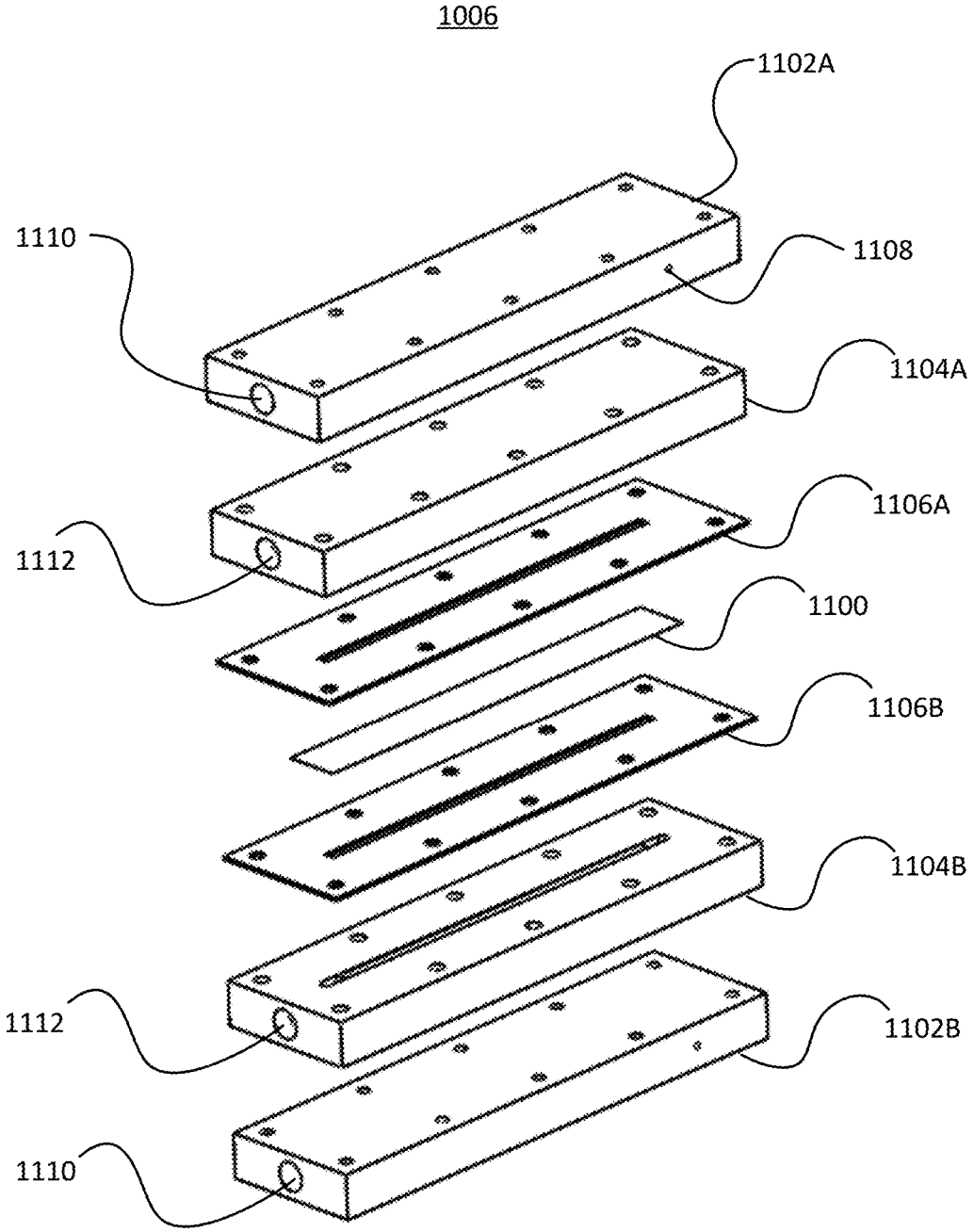
FIGS. 11A through 11D illustrate the components and implementation of a test cell which is used in the test system of FIG. 10 to measure the latent efficiency.

Referring to FIG. 11A, which shows an exploded view of the test cell 1006 from FIG. 10, the test cell 1006 includes a test sample 1100 which includes the microporous barrier material to be tested by the system 1000. The test sample 1100 may have any suitable size (width and length) for the system 1000. For example, a sample width of the test sample 1100 may be about 20 mm, and a sample length of the test sample 1100 may be about 159 mm.

The test cell 1006 includes a pair of aluminum plates 1102, or an upper aluminum plate 1102A and a lower aluminum plate 1102B, for housing the heating elements of the test cell 1006. The heating elements can be coupled via a heating element cavity 1110 as well as via a thermocouple cavity 1108 for receiving the thermocouple. The test cell 1006 includes a pair of polycarbonate plates 1104, or an upper polycarbonate plate 1104A and a lower polycarbonate plate 1104B, that are machined with an airflow channel. The polycarbonate plate 1104 includes an air inlet/outlet connection portion 1112 on both ends to facilitate air flow, as further explained herein. An example of such polycarbonate plate 1104 is shown in FIG. 11D, which is a top view of an exemplary polycarbonate plate having a channel width of about 4 mm, a channel depth of about 0.5 mm and a channel length of about 155 mm, for example. Other configurations of such plate can be used, as suitable for the instrument 1002 employed. The various dimensions of the exemplary rubber gasket and polycarbonate plate as shown in FIGS. 11C and 11D, respectively, are indicated in millimeters (mm).

The test cell 1006 includes a pair of rubber gaskets 1106, or an upper rubber gasket 1106A and a lower rubber gasket 1106B, which may be made of any suitable rubber material including but not limited to ethylene propylene diene monomer (EPDM) rubber, for example. An example of such rubber gasket 1106 is shown in FIG. 11C, which is a top view of an exemplary rubber gasket having a gasket thickness of about 0.5 mm with an airflow channel in the center of the gaskets having a channel width of about 4 mm and a channel length of about 146.1 mm, for example. Other configurations of such rubber gasket can be used, as suitable for the instrument 1002 employed.

The components of the test cell 1006 may be assembled as show in 11B, which is a cross-sectional side view of the test cell 1006 once assembled, and affixed together using any suitable means. In some examples, bolts such as 10-32 stainless steel socket head cap screws (not shown) may be used, which are tightened to any suitable torque, such as 3 in-lb (or 0.339 N-m). During the tests, the test cell 1006 may be wrapped in an insulating blanket (not shown) to maintain a uniform temperature.

The latent efficiency test program may include the following steps. (1) The test cell heating elements are set to 37° C. (2) The temperature of the first and second airflow streams is set to 34° C. The dry air is allowed to flow through the test system for about 40 minutes at a rate of 0.1 liters/minute. (3) The relative humidity level in the two airstreams is increased to 100% with the air temperature set to 34° C. and airflow rate set to 0.1 liters/minute. The humidified air is allowed to flow through the system for about 60 minutes to reach a steady state, when the dew point measurements of the four air streams are recorded. (4) The humidification of the two airflow streams is turned off and the dry air is allowed to flow through the system for about 30 minutes to remove and residual moisture. (5) The flowrate of the two airflow streams is set to 0.2 liters/minute and the dry air is allowed to flow through the system for an additional 40 minutes after which the humidity level in airflow stream is increased to 100% and the test runs for 40 minutes. The data logger for the Scribner test instrument records the dew points, temperatures, air flow rates, and time during the test cycle at a rate of once every ten seconds. (6) Steps 4 and 5 above are repeated with the airflow rate set to 0.45 liters/minute and to 0.6 liters/minute.

Figure 11B:
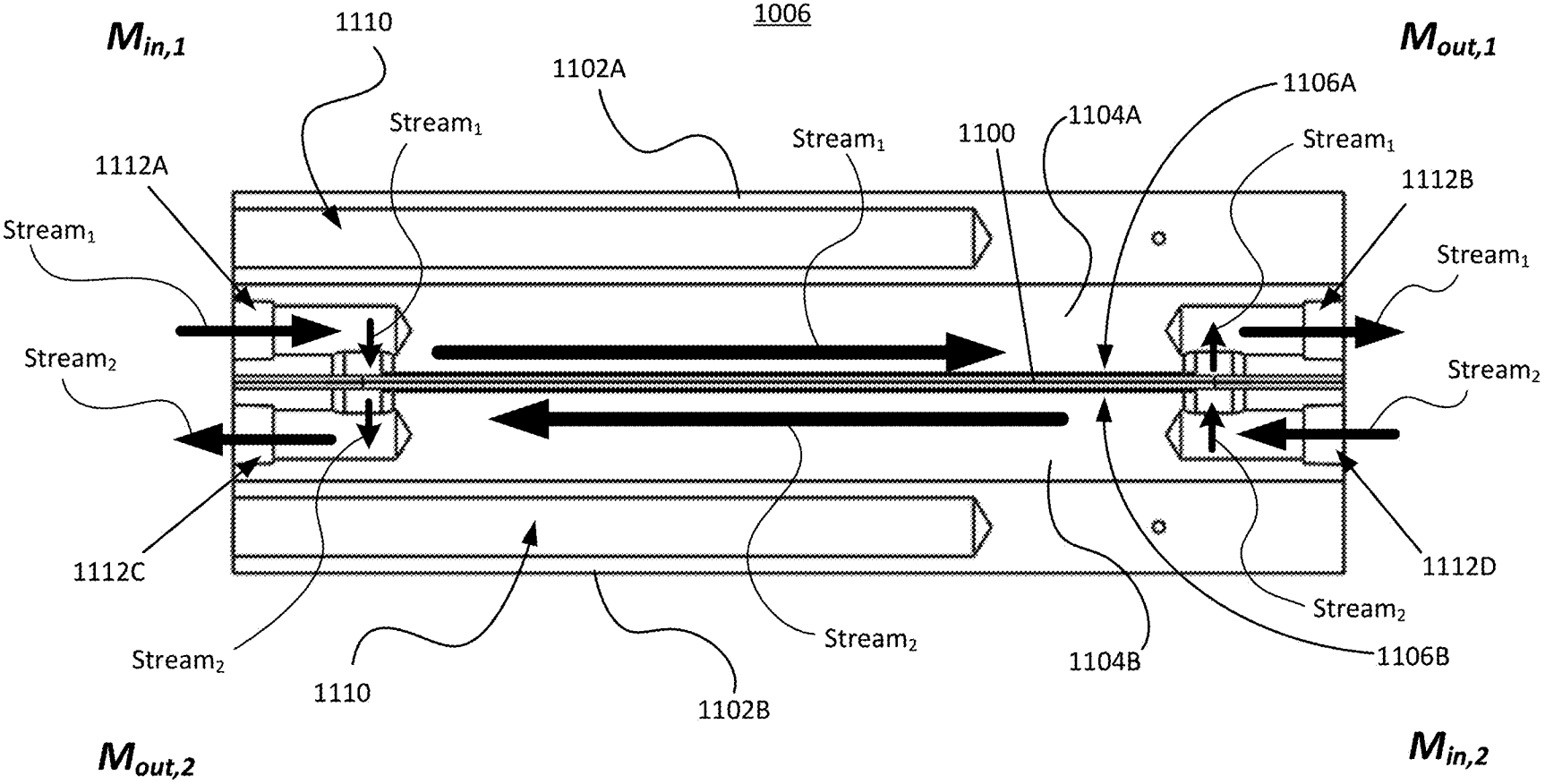
Figure 11C:
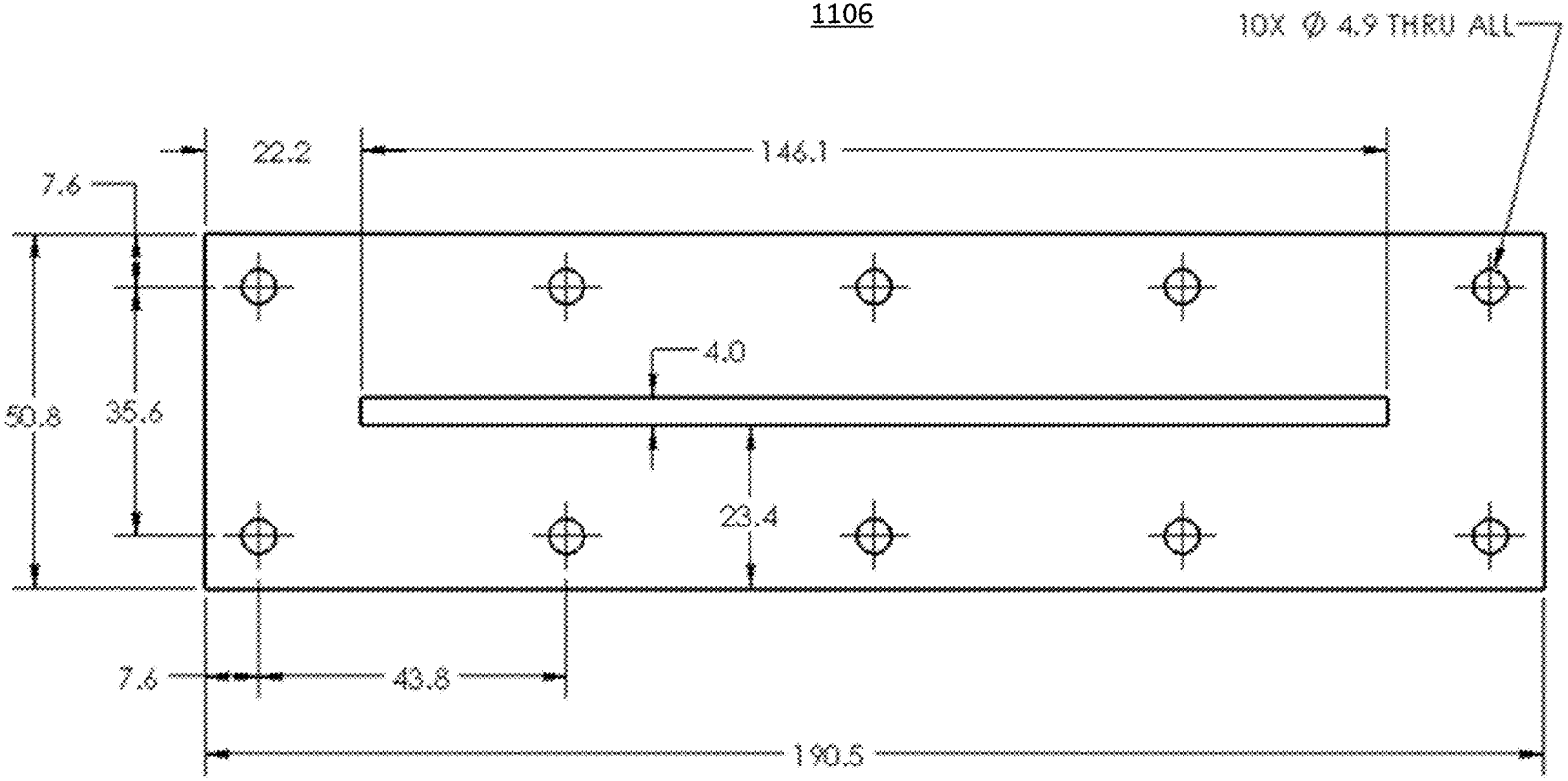
Figure 11D:
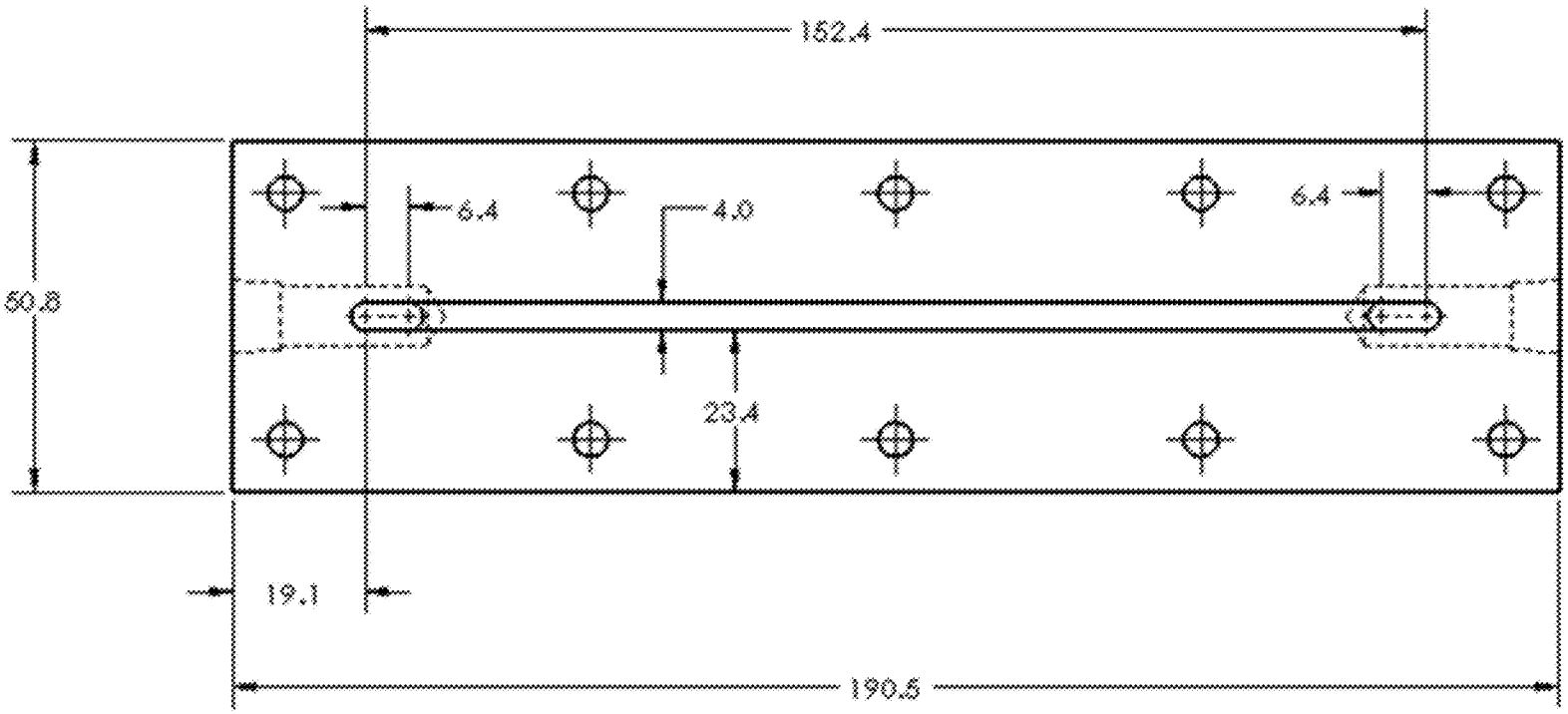

When the test is performed by the system 1000, a more humid airflow stream ($Stream_1$) flows over a first surface of test sample 1100 as shown in FIG. 11B, with a drier air flow stream ($Stream_2$) flowing over an opposite second surface of the test sample 1100 in a counter-current flow. In the example shown, the more humid airflow stream ($Stream_1$) enters via the inlet connection portion 1112A and leaves via the outlet connection portion 1112B, and drier air flow stream ($Stream_2$) enters via the inlet connection portion 1112D and leaves via the outlet connection portion 1112C, as indicated by the bold arrows. The two air streams are separated by the test sample 1100 and sealed within the test cell 1006 by the rubber gaskets 1106. Water vapor permeates through the test sample 1100 from the moister or more humid airflow stream ($Stream_1$) to the drier airstream ($Stream_2$). The chilled mirror hygrometers 1004 monitor the dew point of the air at the inlet and outlets of the test cell 1006 (e.g., via the inlet/outlet connection portions 1112A through 1112D).

The mass of water at each inlet and outlet position of the test cell (that is, the values of $M_{in,1}$, $M_{out,1}$, $M_{in,2}$, and $M_{out,2}$ for Equation 1) can then be calculated using Equation 2 below:

$$M=31.211*e^{0.0599973*D} \quad \text{(Equation 2)}$$

where M is the number of grains of moisture per one pound (0.453592 kg) of dry air, and D is the dewpoint in ° C.

The calculation of the Reynolds Number (Re) is performed using Equation 3 below:

$$Re = 4*\frac{A_{CS}}{P_{CS}}*\frac{\text{(Average Velocity)}}{\text{(Kinematic Viscosity)}} \quad \text{(Equation 3)}$$

where $A_{CS}$ is the channel cross-sectional area, $P_{CS}$ is the channel cross-sectional perimeter, "Average Velocity" is the average velocity of the air through the cell in meters per second, and "Kinematic Viscosity" is the kinematic viscosity of air. The average air velocity "Average Velocity" is calculated from the volumetric flow rate in liters per minute divided by the cross-sectional area of the cell.

To avoid condensation within the air streams and test cell, the air streams and test cell are insulated, and dry plant air in pumped through the system until steady state temperature is achieved.

Further disclosed herein are methods of obtaining a Gurley number (or Gurley second) of a film. A Gurley number, or Gurley second, is a measure of the air permeability through a film. The Gurley second is the time required for 100 cubic centimeters of air to pass through a 1 square inch area of the film at a pressure differential of 4.88 inches of water (0.176 psi or 1213.5 Pa). The air permeability of a film sample is measured using a Gurley densometer (for example, Model 4340) available from Gurley Precision Instruments of Troy, NY, U.S.A., although any suitable device may be employed for such measurement.

Figure 12A:
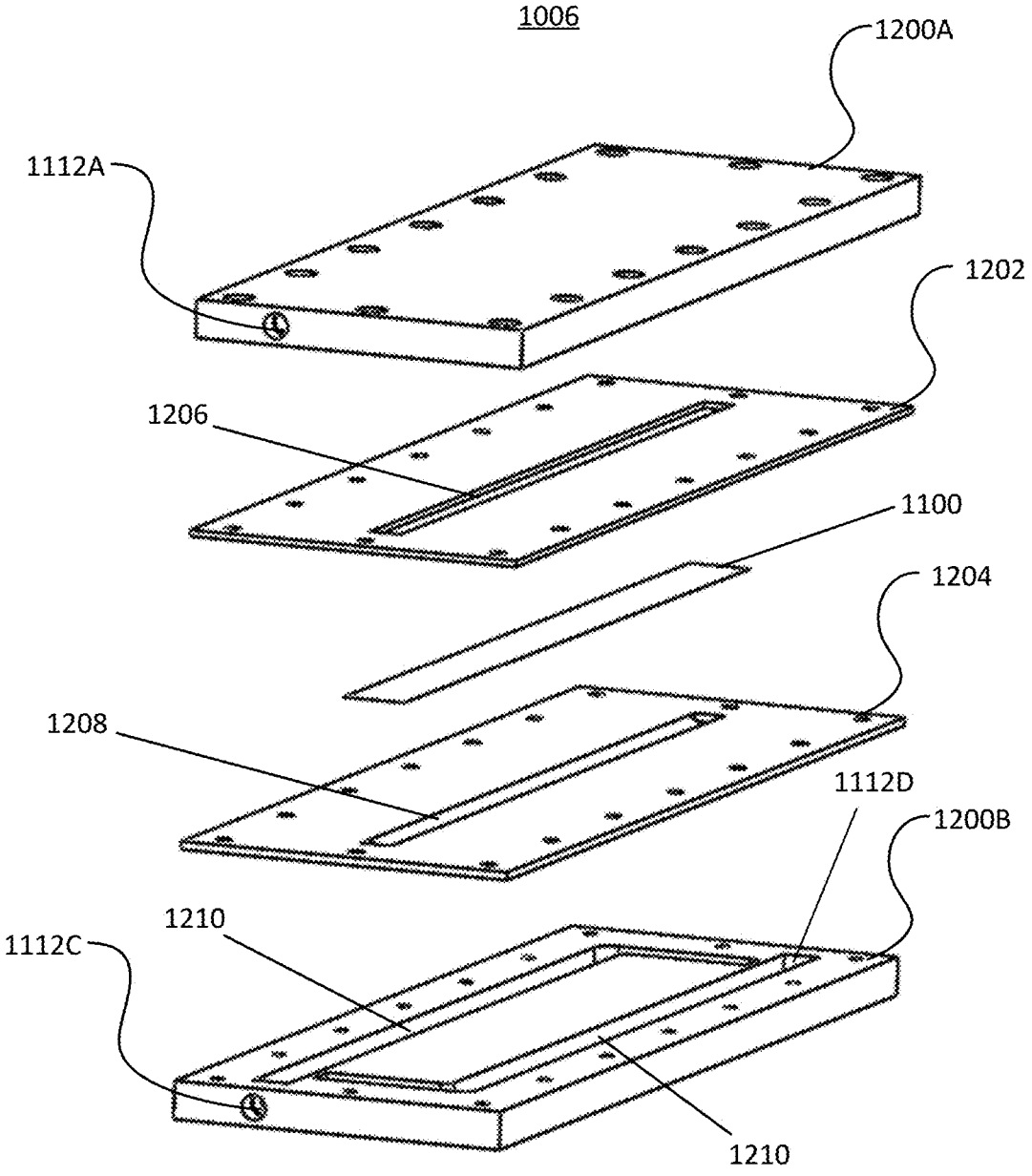
FIGS. 12A and 12B illustrate the components and implementation of the test cell used in the test system of FIG. 10 in another configuration.
Figure 12B:
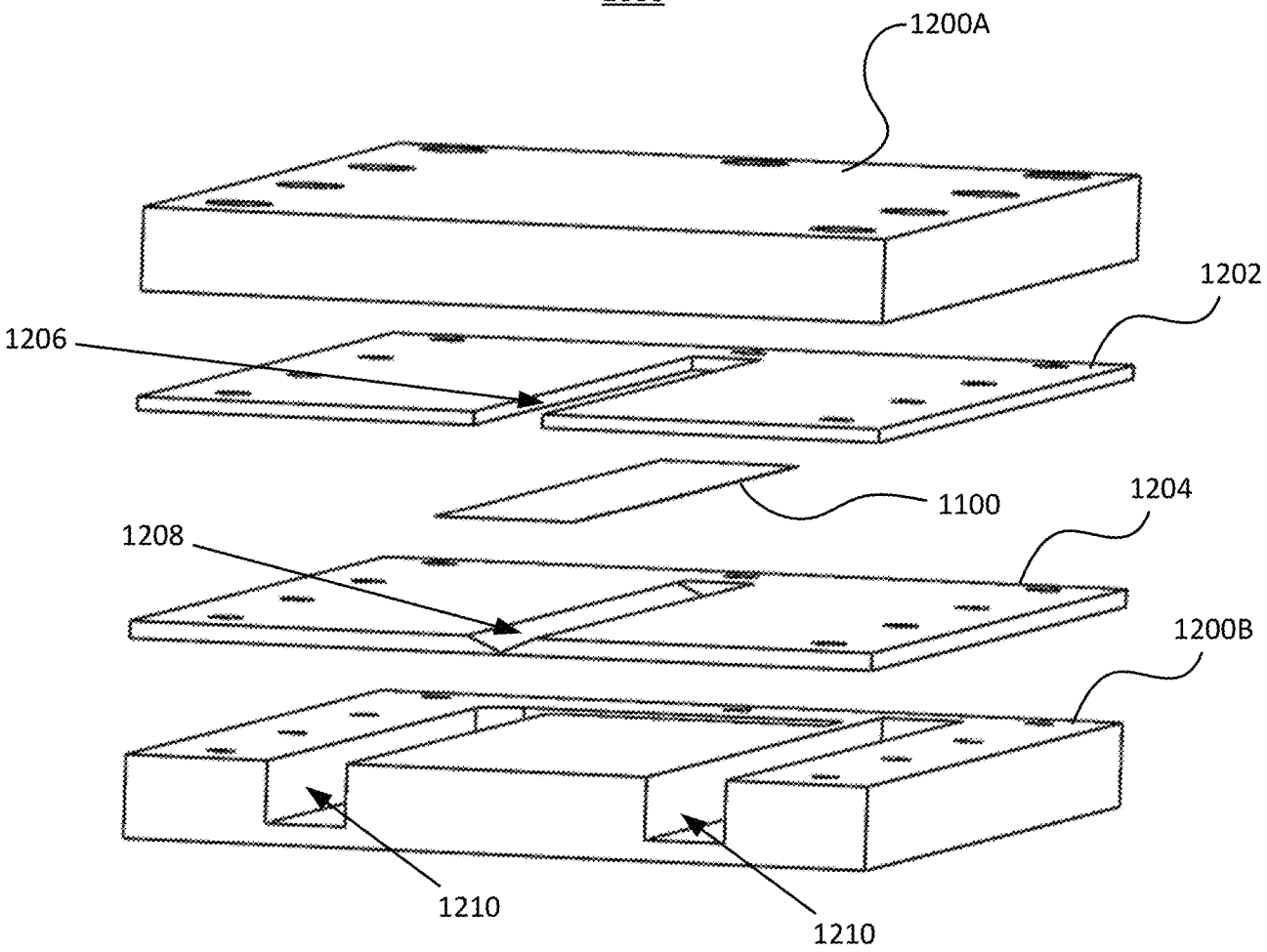
Figure 12C:
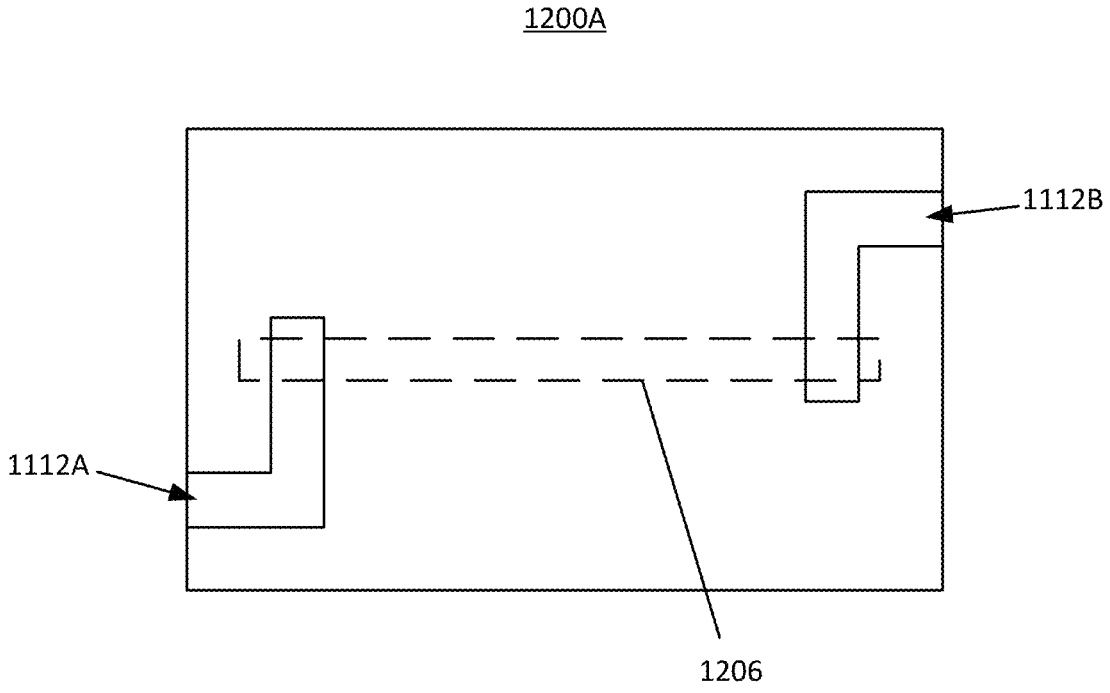
FIG. 12C is a bottom view of the upper plate implemented in the test cell of FIGS. 12A and 12B.

FIGS. 12A, 12B, and 12C show another example of performing the test using Scribner Fuel Cell Test Load Instrument 1002, using the test cell 1006 with a different configuration. The test cell 1006 includes test cell plates 1200 (upper plate 1200A and lower plate 1200B), a first gasket 1202, and a second gasket 1204. The first gasket 1202 includes a rectangular channel 1206, and the second gasket 1204 includes a triangular channel 1208. Each plate 1200 includes heating element cavities 1210. The test sample 1100 is disposed between the gaskets 1202 and 1204. The gaskets 1202 and 1204 are disposed between the plates 1200. In this configuration, for example, a moist air flow stream ($Stream_1$) may enter via the inlet connection portion 1112A, passes through the rectangular channel 1206 and leaves via the outlet connection portion 1112B (shown in FIG. 12C), and a drier air flow stream ($Stream_2$) may enter via the inlet connection portion 1112D, passes through the triangular channel 1208 and leaves via the outlet connection portion 1112C.

Warm plant air (38-42° C.) is bubbled through water in the humidification chamber at fixed flow rates of 0.2, 0.4, 0.6, and 0.8 liters per minute to humidify the air to a dew point between 35.7 and 36.8° C. This is pumped through the triangular channel 1208 of the approximately 250 mm long test cell 1100. In a countercurrent flow, warm plant air (33.0-33.5° C.) is pumped through the rectangular channel 1206 at the same flow rates of 0.2, 0.4, 0.6, and 0.8 liters per minute. The dewpoint of both air streams are recorded with a chilled mirror hygrometry chamber (e.g., using the chilled mirror hygrometers 1004) before and after the test cell 1100 and used to calculate the latent efficiency of the moisture transfer across the barrier laminate. From this calculation, the latent efficiency ($E_{lat}$) and the Reynolds Number (Re) can be calculated as explained above.

The invention of this application has been described above both generically and with regard to specific embodiments. It will be apparent to those skilled in the art that various modifications and variations can be made in the embodiments without departing from the scope of the disclosure. Thus, it is intended that the embodiments cover the modifications and variations of this invention provided they come within the scope of the appended claims and their equivalents.

What is claimed is:

1. An airflow conditioning device comprising:

a first channel defining a first airflow pathway through the airflow conditioning device and a second channel defining a second airflow pathway through the airflow conditioning device;

a heat and moisture exchanger disposed in the airflow conditioning device, the first and second channels each passing through the heat and moisture exchanger, the heat and moisture exchanger comprising a plurality of air-permeable barriers separating the first airflow pathway from the second airflow pathway, at least one of the plurality of air-permeable barriers comprising:

a layer of a microporous film comprising a first surface and a second surface opposite of the first surface, and a water vapor permeable resin layer adjoined to the first surface, the second surface, or both the first and second surfaces of the microporous film so as to form a discontinuous nonporous coating thereon.

2. The airflow conditioning device of claim 1, wherein the microporous film includes expanded polytetrafluoroethylene (ePTFE), expanded Polyethylene (ePE), or a combination thereof.

3. The airflow conditioning device of claim 1, wherein the water vapor permeable resin layer includes polyurethane.

4. The airflow conditioning device of claim 1, wherein the microporous film is adjoined to a mesh.

5. The airflow conditioning device of claim 1, wherein the microporous film is heat laminated to an extruded mesh component.

6. The airflow conditioning device of claim 1, wherein the microporous film is a component of a nonwoven fabric.

7. The airflow conditioning device of claim 1, wherein the microporous film is dot laminated to a nonwoven fabric.

8. The airflow conditioning device of claim 1, further comprising:

a boundary layer defined by a surface of the at least one of the plurality of air-permeable barriers, and at least one spacer arranged at or adjacent to the surface of the at least one of the plurality of air-permeable barriers to disrupt a portion of the boundary layer.

9. The airflow conditioning device of claim 8, wherein the disrupted portion of the boundary layer includes a reduced-thickness region of the boundary layer in which heat or water vapor transfer through the at least one of the air-permeable barriers is enhanced with respect to an undisrupted portion of the boundary layer.

10. The airflow conditioning device of claim 1, wherein the layer of microporous film includes a porosity of no greater than 90%.

11. The airflow conditioning device of claim 1, wherein the at least one of the plurality of air-permeable barriers includes a latent efficiency of at least 70% at a Re value of inclusively between 50 and 85.

12. The airflow conditioning device of claim 1, wherein the at least one of the plurality of barriers has an air permeability of inclusively between 300 and 5000 Gurley seconds.

13. The airflow conditioning device of claim 1, wherein the discontinuous coating is applied in a substantially uniform distribution on the first surface, the second surface, or both the first and second surfaces.

14. The airflow conditioning device of claim 13, wherein the discontinuous coating is applied in a pattern on the first surface, the second surface, or both the first and second surfaces.

15. A method of conditioning an airflow passing through an airflow conditioning device, the method comprising:

directing a first airflow through a first airflow pathway through the airflow conditioning device and directing a second airflow through a second airflow pathway through the airflow conditioning device;

directing both the first and second airflows through a heat and moisture exchanger disposed within the airflow conditioning device, the heat and moisture exchanger comprising a plurality of air-permeable barriers separating the first airflow from the second airflow; and conditioning the second airflow by transferring thermal energy and humidity from the first airflow to the second airflow through at least one of the plurality of air-permeable barriers, wherein the at least one of the plurality of air-permeable barriers includes a layer of a microporous film and a water vapor permeable resin layer adjoined to a first surface of the microporous film, a second surface of the microporous film opposite from the first surface, or both the first and second surfaces of the microporous film so as to form a discontinuous nonporous coating thereon.

16. The method of claim 15, wherein the layer of microporous film includes expanded polytetrafluoroethylene (ePTFE), expanded polyethylene (ePE), or a combination thereof.

17. A system comprising:

a first channel defining a first airflow pathway through the airflow conditioning device and a second channel defining a second airflow pathway through the airflow conditioning device; and a heat and moisture exchanger disposed within the airflow conditioning device, the heat and moisture exchanger comprising a plurality of air-permeable barriers separating the first airflow pathway from the second airflow pathway, at least one of the plurality of air-permeable barriers comprising a layer of a microporous film having a first surface and a second surface opposite of the first surface, and a water vapor permeable resin layer adjoined to the first surface, the second surface, or both the first and second surfaces of the microporous film so as to form a coating thereon defining a first surface region that is microporous and a second surface region that is nonporous, such that the first and second surface regions are disposed adjacent to each other.

18. The system of claim 17, wherein the layer of microporous film includes expanded polytetrafluoroethylene (ePTFE), expanded polyethylene (ePE), or a combination thereof.

* * * * *